US012331600B2

(12) United States Patent
Amezaga et al.

(10) Patent No.: US 12,331,600 B2
(45) Date of Patent: Jun. 17, 2025

(54) SAFETY CLUTCH SYSTEM FOR CIRCULATION/FILL-UP/FLOWBACK TOOL

(71) Applicant: WEATHERFORD TECHNOLOGY HOLDINGS, LLC, Houston, TX (US)

(72) Inventors: Federico Amezaga, Houston, TX (US); Ernst Führing, Langenhagen (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 27 days.

(21) Appl. No.: 17/899,836

(22) Filed: Aug. 31, 2022

(65) Prior Publication Data

US 2024/0068307 A1 Feb. 29, 2024

(51) Int. Cl.
*E21B 19/16* (2006.01)
*E21B 3/02* (2006.01)

(52) U.S. Cl.
CPC ..... *E21B 19/165* (2013.01); *E21B 3/022* (2020.05)

(58) Field of Classification Search
CPC ..... E21B 19/165; E21B 3/022
See application file for complete search history.

(56) References Cited

U.S. PATENT DOCUMENTS

| | | | |
|---|---|---|---|
| 6,378,630 | B1 | 4/2002 | Ritorto et al. |
| 6,476,268 | B1 | 11/2002 | Winsel et al. |
| 7,712,523 | B2 | 5/2010 | Snider et al. |
| 7,770,635 | B2 | 8/2010 | Angman |
| 7,975,765 | B2 | 7/2011 | Manson |
| 8,118,106 | B2 | 2/2012 | Wiens et al. |
| 8,141,642 | B2 | 3/2012 | Olstad et al. |
| 8,230,933 | B2 | 7/2012 | Snider et al. |
| 8,297,347 | B2 | 10/2012 | Ruark et al. |
| 8,573,329 | B2 | 11/2013 | Begnaud et al. |
| 9,416,601 | B2 | 8/2016 | Mullins et al. |
| 9,528,326 | B2 | 12/2016 | Heidecke et al. |
| 9,745,810 | B2 * | 8/2017 | Wiens ..... E21B 19/02 |

(Continued)

FOREIGN PATENT DOCUMENTS

| | | | |
|---|---|---|---|
| CA | 2807650 | A1 | 2/2012 |
| WO | 0179652 | A1 | 10/2001 |
| WO | 2006116870 | A1 | 11/2006 |

OTHER PUBLICATIONS

Weatherford, "AutoSeal II Fill-Up and Circulation Tools," Brochure, copyright 2011-2014, 6-pgs.

(Continued)

*Primary Examiner* — Theodore N Yao
(74) *Attorney, Agent, or Firm* — Cabello Hall Zinda, PLLC

(57) ABSTRACT

A flowback tool is used on a top drive for delivering fluid flow to a tubular, such as a drillpipe or casing. A mechanical stroke on the tool has a mandrel with a mud saver valve and has a barrel. The mandrel connects to a quill of the top drive and has a coupling that can be threaded with the tubular's box connection. The barrel disposed on the mandrel can be moved by a cam engagement as the mandrel is rotated. When prevented from rotating, the barrel can thereby move in a stroke direction along an axis. An annular seal on the barrel is configured to sealably engage with the tubular. A clutch disposed on the barrel can prevent rotation of the barrel when the clutch is engaged with a portion (bail) of the top drive. However, a toque threshold of the clutch allows for slippage during operations.

22 Claims, 20 Drawing Sheets

(56) References Cited

U.S. PATENT DOCUMENTS

| | | | | |
|---|---|---|---|---|
| 9,784,054 | B2 | 10/2017 | Wilson et al. | |
| 10,132,127 | B2 | 11/2018 | Hickl | |
| 11,225,854 | B2 | 1/2022 | Helms et al. | |
| 11,371,286 | B2 * | 6/2022 | Aas | E21B 19/06 |
| 2009/0229837 | A1 | 9/2009 | Wiens et al. | |
| 2009/0274545 | A1 * | 11/2009 | Liess | E21B 19/06<br>414/800 |
| 2014/0151067 | A1 * | 6/2014 | Hart | E21B 43/10<br>166/85.1 |
| 2016/0024862 | A1 * | 1/2016 | Wilson | E21B 3/035<br>166/380 |
| 2018/0340372 | A1 * | 11/2018 | Slack | E21B 17/02 |
| 2021/0381320 | A1 | 12/2021 | Henderson et al. | |

OTHER PUBLICATIONS

Weatherford, "Top-Drive Stand Compensator," Brochure, copyright 2012-2014, 3-pgs.

Weatherford, "TorkDrive™ Electronic Modular Casing-Running and Drilling Tool," Brochure, copyright 2014-2015, 7-pgs.

Int'l Search Report and Written Opinion in counterpart PCT Appl. No. PCT/US2023/023652 mailed Aug. 22, 2023, 15-pgs.

* cited by examiner

SAFETY CLUTCH SYSTEM FOR CIRCULATION/FILL-UP/FLOWBACK TOOL

BACKGROUND OF THE DISCLOSURE

Tubing strings, such as drillpipes and casing, are deployed into a wellbore during operations to drill and case the wellbore. It may also be necessary to remove the tubing strings from the wellbore during operation. Intervention operations (e.g., fishing a broken or stuck tubular or tool) and workover operations also require deploying and removing tubing strings.

When a tubing string is being run into or pulled from the wellbore, it is often necessary to fill the tubing string with fluid (e.g., mud), to take fluid returns from the tubular string, or to circulate fluid (e.g., mud) through the tubular string. To establish fluid communication between the rig and the tubing string, a portion of a top drive can be threaded to the tubular string, a portion of the top drive can be at least partially inserted into the tubing string, or a circulation head can be connected to the tubing string.

Usually, a mud saver valve is used at the fluid connection to prevent spillage of fluid (i.e., mud) when the components for the fluid connection (e.g., top drive/Kelly hose or circulation head) are disconnected from the tubing string. As expected, the mud saver valve can prevent the loss of mud, can prevent unsafe operating conditions for personnel, and can minimize contamination of the environment.

To make the fluid connection, precise spacing is required for a seal assembly on the components used to establish the fluid communication with the tubing string. Typically, the end of the tubing string is supported by an elevator on the top drive. The elevator can be a slip-type elevator or can be a "side door" or a latching elevator. The seal assembly on the top drive is then brought into sealing engagement with the tubing string. Also, the main shaft (e.g., quill) of the top drive can be threaded to the tubing string.

A mechanical stroke tool can be used to make the connection between the top drive and the tubing string. The mechanical stroke tool can be extended by the rotation of the top drive's quill so the fluid connection can be made between the top drive and the tubing string. To unmake the connection, the mechanical stroke tool can also be retracted by the reverse rotation of the top drive's quill.

During these operations, however, the rotation of the top drive must be stopped at a predefined position to avoid damage to the mechanical stroke, its seals, and its thread mechanism. This applies to both the retracting and extending directions. The driller relies on visual markings (e.g., tape) on the bails of the top drive to show the positions for maximum extension and retraction of the tool. In some instances, the driller may over-extended and over-retract the stroke of the mechanical stroke tool, which can damage the tool. As expected, replacing the damaged tool can cause extended downtime on the rig.

The subject matter of the present disclosure is directed to overcoming, or at least reducing the effects of, one or more of the problems set forth above.

SUMMARY OF THE DISCLOSURE

A flowback tool disclosed herein is used on a top drive for delivering fluid flow to a tubular. The flowback tool comprises a mechanical stroke tool and a clutch. The mechanical stroke has an inner body and an outer body with the inner body disposed in the outer body. The inner body is rotatable about an axis, and the outer body is movable in a stroke direction along the axis. For example, the outer body or barrel of the mechanical stroke can be moved by a cam/threaded engagement as the inner body or mandrel is rotated.

The inner body has a flow passage therethrough between a connection and a coupling. The connection is configured to connect to the top drive, and the coupling is configured to removably thread to the tubular. The flow passage has a valve configured to control fluid communication between the coupling and the connection. A first end of the outer body is disposed toward the connection, and a second end is disposed toward the coupling. The second end has an annular seal configured to sealably engage with the tubular.

The clutch has first and second portions, which define an interface with a torque threshold. The first portion is fixed on the outer body of the mechanical stroke, and the second portion has a disengaged condition and an engaged condition. The second portion in the engaged condition is configured to engage with a portion of the top drive, and the second portion in the engaged condition is configured to move with the first portion up to the torque threshold. The second portion in the engaged condition is configured to slip relative to the first portion beyond the torque threshold.

In one configuration, the first portion of the clutch can comprise a housing, a first brake pad, and a second brake pad. The housing has first and second shoulders and is fixed to the outer body of the mechanical stroke. The first brake pad is disposed in the housing adjacent to the first shoulder, and the first brake pad is configured to rotate with the housing. The second brake pad is disposed in the housing adjacent to the second shoulder, and the second brake pad is configured to rotate with the housing. One or more biasing elements are configured to bias the first brake pad away from the first shoulder.

Meanwhile, in this configuration, the second portion of the clutch can comprise a slip ring and an arm. The slip ring is disposed in the housing and has first and second surfaces. The first surface is engaged with the first brake, and the second surface is engaged with the second brake. The first and second surfaces engaged with the first and second brakes defines the interface with the torque threshold. The arm is connected to the slip ring. The arm is configured to extend radially outward from the slip ring to engage with the portion of the top drive, such as a bail of the top drive.

In another configuration, the first portion of the clutch can comprise a housing and a slip ring. The housing has a first shoulder, and the slip ring has a second shoulder. The housing and the slip ring are fixed on the outer body of the mechanical stroke. One or more biasing elements are configured to bias the first shoulder of the housing toward the second shoulder of the slip ring. Meanwhile, the second portion of the clutch can comprise a rotatable brake ring having first and second brake pads. The first and second brake pads are configured to engage the first and second shoulders respectively and define the interface with the torque threshold. The rotatable brake ring has the disengaged condition and the engaged condition. For instance, the rotatable brake ring in the engaged condition is configured to engage with the portion of the top drive so that the rotatable brake ring is configured to move with the housing and the slip ring of the first portion up to the torque threshold. However, the rotatable brake ring in the engaged condition is configured to slip relative to the housing and the slip ring of the first portion beyond the torque threshold.

A clutch is disclosed herein and is used on a top drive having a rotatable component and a bail. The clutch comprises a first portion and a second portion as described above.

A top drive is disclosed herein and is used for delivering fluid flow to a tubular. The top drive comprises: a quill extending from the top drive; bails supported on the top drive on either side of the quill; an elevator supported on the bails and configured to support the tubular; and a flowback tool, as described above, connected to the quill.

A method disclosed herein comprises: supporting a tubular in an elevator of a top drive; extending a barrel of a flowback tool relative to a mandrel of the flowback tool by rotating the mandrel in a first direction with the top drive while preventing rotation of the barrel with a clutch; establishing a fluid connection between the mandrel and the tubular by engaging a seal on the barrier in sealed engagement with an end of the tubular; and permitting the barrel to rotate in the first direction with the rotation of the mandrel by releasing the clutch in response to a torque threshold.

The foregoing summary is not intended to summarize each potential embodiment or every aspect of the present disclosure.

DETAILED DESCRIPTION OF THE DISCLOSURE

Figure 1:
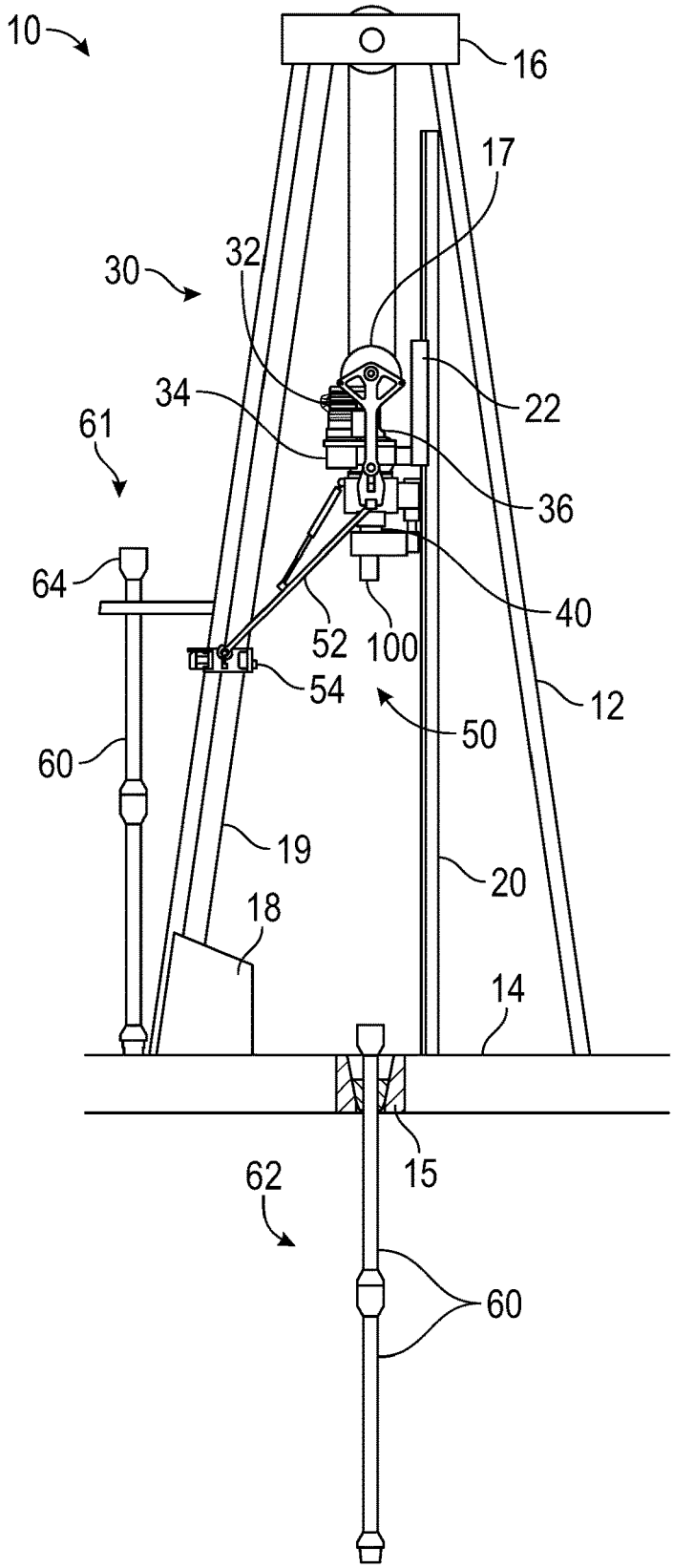
FIG. 1 illustrates a rig having a top drive and a flowback tool according to the present disclosure.

FIG. 1 illustrates a rig 10 having a top drive 30 and a flowback tool 100 according to the present disclosure. The rig 10 is shown here as a drilling rig, but the features of the present disclosure can be used for other installations. As described below, the top drive 30 typically includes a non-rotating frame having a motor 32, a Kelly hose connection, a gearbox 34, a quill 40, a pipe handler 50, and several other components. To support the top drive 30, the rig 10 includes a derrick 12 having a rig floor 14, a crown block 16, a traveling block 17, a rail 20, and several other components.

Briefly, the rig floor 14 has an opening 15 through which a tubing string 62 (such as drillpipe or casing) extends downwardly through a BOP and into a wellbore (not shown). The rail 20 extends from the rig floor 14 toward the crown block 16, and the traveling block 17 is supported by wire rope 19 connected to the crown block 16. The wire rope 19 is wound through sheaves of the crown block 16 and extends to drawworks 18 used for reeling (raising or lowering) the traveling block 17 relative to the derrick 10.

As noted, the top drive 30 has a non-rotating frame that includes the motor 32, the gearbox 34, an inlet 36, a swivel 38, the quill 40, and the like. The frame is supported on a trolley 22, which can ride along the rail 20 so the top drive 30 can move vertically with the traveling block 17 of the rig hoist.

The top drive 30 is used for handling tubulars 60, such as on a stand 61, so the stand 61 can be connected to the tubular string 62. In particular, the top drive motor 32, which can be electric or hydraulic, is operable to torsionally drive the quill 40, which can also be referred to as a main shaft or a drive stem. For example, the motor 32 can drive rotation of the quill 40 through the gearbox 34 or can drive the quill 40 directly without a gearbox. The quill 40 extends downwardly through other components of the top drive 30, and the flowback tool 100 is longitudinally and torsionally connected to the quill 40, such as by a threaded connection.

The swivel 38 supports rotation of the quill 40 relative to the top drive's frame. For example, the swivel 38 provides fluid communication between the non-rotating Kelly hose connection and the rotating quill 40 of the motor 32 for communicating fluid through the top drive 30. The swivel 38 also connects to the traveling block 17 for transferring the weight of the top drive 30 from the rotating quill 40 to the non-rotating traveling bock 17. The inlet 36 connects to a Kelly hose (not shown) and provides fluid communication between the Kelly hose and a bore of the quill 40. Finally, the quill 40 has a coupling, such as a threaded pin, formed at a lower end thereof connected to the flowback tool 100.

The pipe handler 50 has an elevator 54 that extends with bails 52 from the top drive 30 and is used for handling the tubulars 60. For example, each bail 52 is supported on a lifting lug of the top drive's frame, and each bail 52 connects to a respective lifting lug of the elevator 54. A link tilt can also be provided for swinging the elevator 54 relative to the top drive frame.

In operation, the pipe handler 50 engages the stand 61 and delivers the stand 61 to the tubing string 62 where the stand 61 can then be assembled therewith to extend the tubing string 62 during operations. To do this, the elevator 54 can be manually opened and closed on the tubular 60 of the stand 61, or the pipe handler 50 can include an actuator (not shown) for opening and closing the elevator 54. In general, the elevator 54 can include a bushing having a profile, such as a bottleneck, that is complementary to an upset formed on an end of the tubular. Alternatively, the elevator 54 may have a gripper, such as slips and a cone, capable of engaging an outer surface of the tubular 60 at any location therealong.

When closed on the tubular, the elevator 54 supports the tubular 60 for hoisting the stand 61 of preassembled joints. (In the present discussion and those that follow, the tubular 60 is shown and discussed as drillpipe, but it will be understood that other forms of tubulars can be used, such as casing.)

When the top drive 30 manipulates the stand 61, the flowback tool 100 can interface with the end 64 of the tubular 60 in a fluid connection and in a mechanical connection as discussed below. In particular, the flowback tool 100 supported on the top drive 30 is a fully mechanical tool that can be controlled by a driller using the rotation imparted by the top drive 30 via the motor 32 and quill 40. When operated, the flowback tool 100 can connect to the end 64 of the tubular 60 in a fluid connection so fluid communication can be made with the tubular 60. For example, with the elevator 54 supporting the tubular 60 below the top drive 30, the quill 40 can be rotated to establish a fluid connection between the flowback tool 100 and the upper end of the tubular 60.

Additionally, the flowback tool 100 can also connect to the end 64 of the tubular 60 in a mechanical connection so that, in addition to the fluid communication, the weight of the tubular 60, stand 61, and the like can be supported by the tool 100 and rotation can be imparted thereto with the rotation of the quill 40. For example, the quill 40 is rotated to thread a portion of the flowback tool 100 to the tubular's end (i.e., box connection) 64. Threading the tubular 60 onto an intermediate component, such as the flowback tool 100 connected to the quill 40, can reduce wear on the threaded end of the quill 40. Once connected to the quill 40, the tubulars 60 on the stand 61 can be added to a tubing string 62 held at the rig floor 14 by lowering the tubing stand 61 and threading it into the rest of the tubing string 62.

Figure 2A:
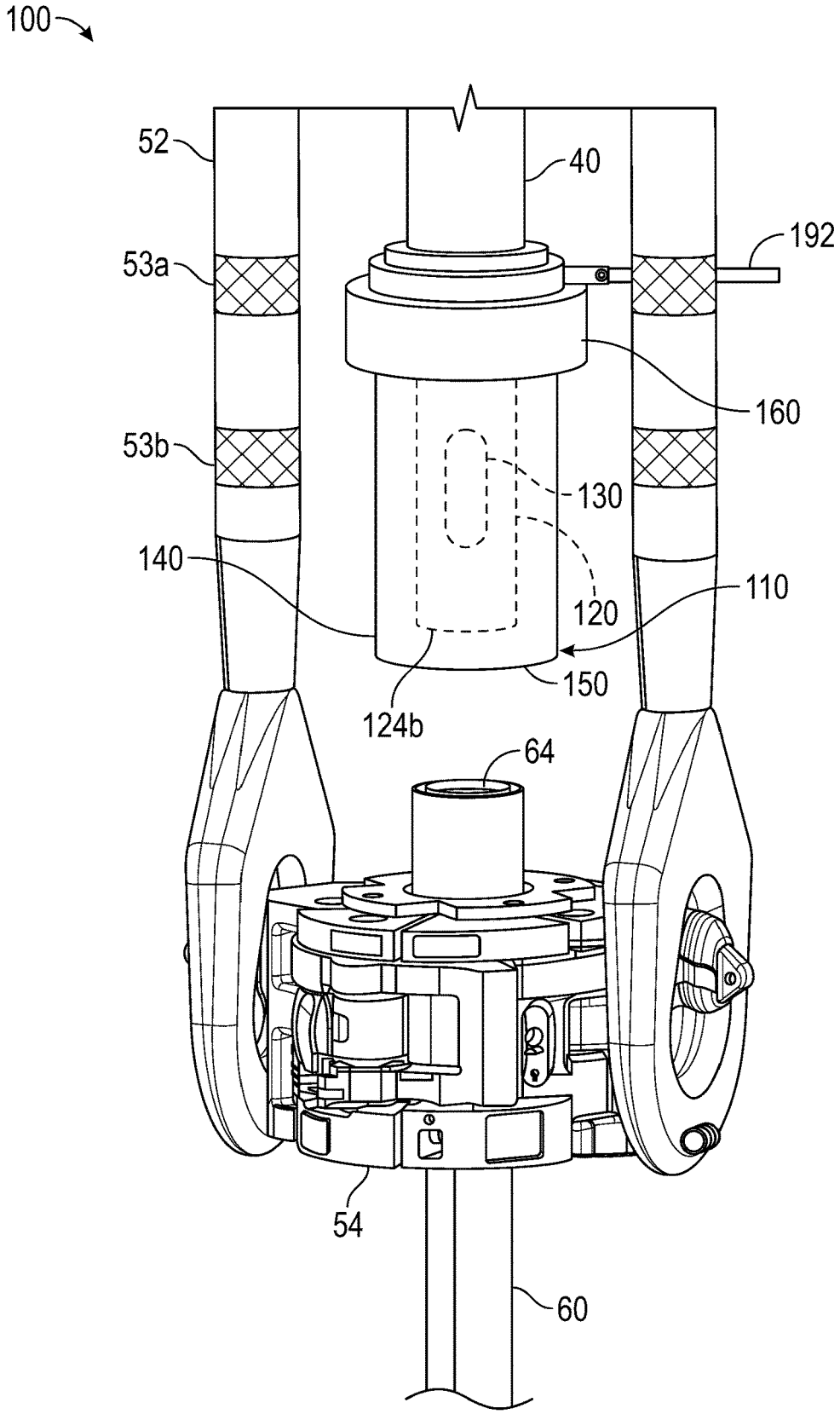
FIG. 2A illustrates the flowback tool in a retracted position.
Figure 2B:
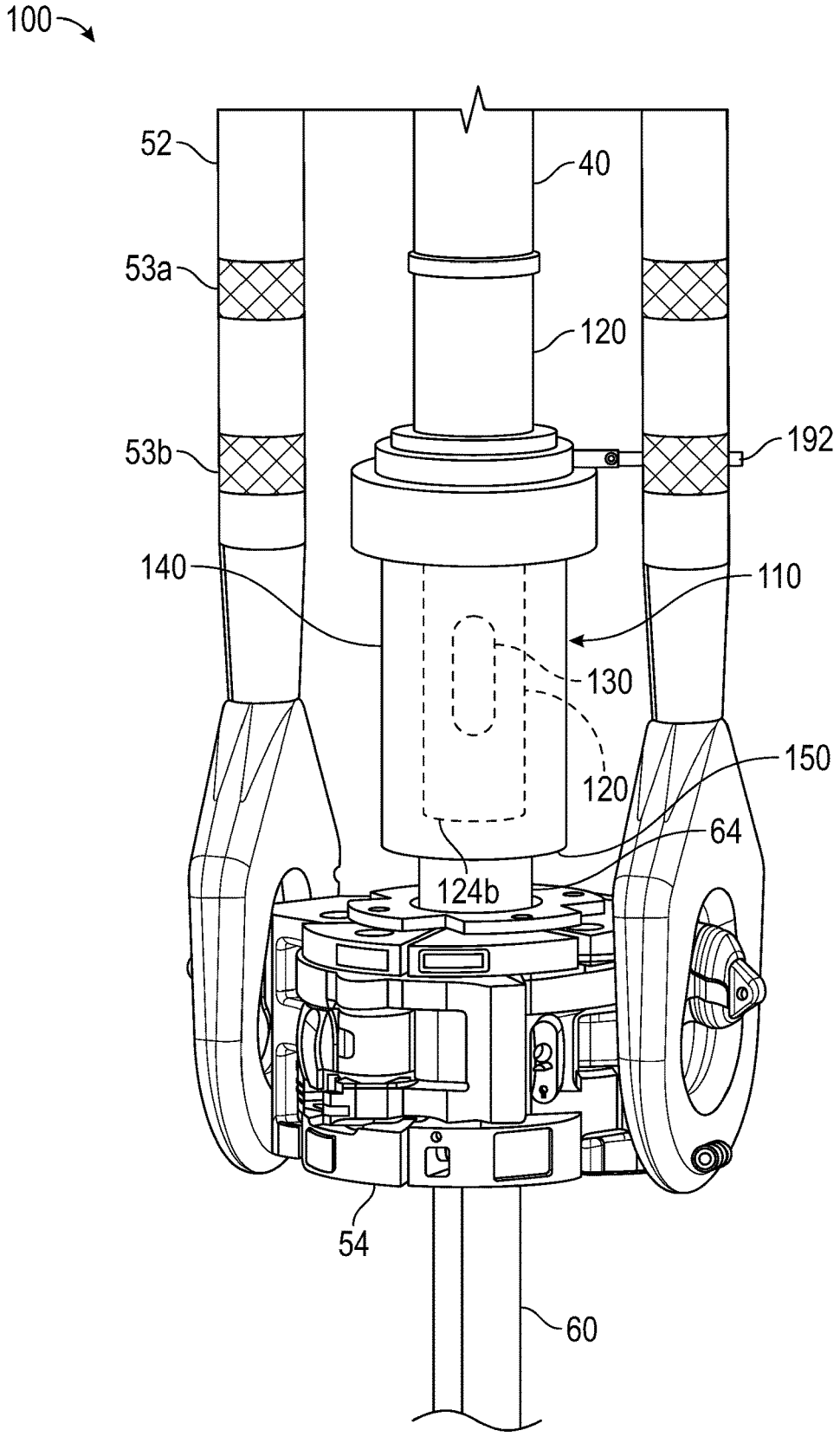
FIG. 2B illustrates the flowback tool in an engaged position.

FIG. 2A illustrates the flowback tool 100 in a retracted condition relative to a box connection 64 of the tubular 60, and FIG. 2B illustrates the flowback tool 100 in an extended condition relative to the box connection 64 of tubular 60. The flowback tool 100 includes a mechanical stroke tool 110 and a clutch 160. The mechanical stroke tool 110 includes an inner body or mandrel 120 disposed in an outer body, cylinder, or barrel 140. The mandrel 120 is coupled with a connection (not shown) to the quill 40 of the top drive (30) or any lower sub and can be rotatable about an axis. Meanwhile, the barrel 140 is movable in a stroke direction along the axis.

The mandrel 120 has a flow passage therethrough having a valve 130, which is a mud saver valve as discussed below. An annular seal 150 on the end of the barrel 140 is configured to sealably engage with the tubular 60. For example, the annular seal 150 can sealingly engage an outer surface of the tubular 60 at its box connection 64, thereby providing fluid communication between the top drive (30) and the bore of the tubular 60. Additionally, a coupling or cross-over 124*b* on the mandrel 120 is configured to removably thread to the box connection 64 of the tubular 60. This may be done so a mechanical connection can be made, such as when a well control operation needs to be performed or when the weight of a tubing string needs to be supported.

For its part, the clutch 160 has a torque interface between the clutch's components, as discussed in more detail below. For example, one portion of the clutch 160 is fixed on the barrel 140 of the mechanical stroke tool 110. Another portion of the clutch 160 includes an anti-rotation arm 192, which can have disengaged and engaged conditions with a portion of the top drive (30). In particular, the anti-rotation arm 192 on the clutch 160 can contact a bail 52 of the top drive (30) to allow extension/retraction of the mechanical stroke barrel 140. The driller can use visual indicators 53*a-b* on the bails 52 for determining the extended/retracted positions of the mechanical stroke's barrel 140, and the clutch 160 can avoid damage to the flowback tool 100 when overextending/retracting the stroke barrel 140.

During operations, the outer barrel 140 of the mechanical stroke tool 110 can be moved by a cam/threaded engagement as the mandrel 120 is rotated. The barrel 140, when prevented from rotating with the mandrel 120 by engagement of the clutch 160 with the bail 52, can thereby move in a stroke direction along the axis. The annular seal 150 on the distal end of the barrel 140 can then sealably engage with the tubular 60, such as shown in FIG. 2B.

The driller can use the alignment of the arm 192 with the visual indicators 53*a-b* of the bail 52 when controlling the extension/retraction of the barrel 140 with the rotation of the mandrel 120 by the top drive 30. When the torque threshold of the clutch 160 is reached, the second portion of the clutch 160 having the arm 192 can slip relative to the clutch's first portion fixed to the barrel 140. At this point, the clutch 160 can allow the barrel 140 to rotate with the rotation of the mandrel 120, except that a certain amount of friction of the annular seal 150 engaged with the tubular 60 may hinder the cylinder's rotation. In the meantime, the coupling 124*b* of the mandrel 120 can be threaded with the box connection 64 of the tubular 60. Establishing this threaded connection can be used for well control operations so that fluid communication can be established between the mandrel 120 and tubular 60. Additionally, establishing this threaded connection can be used when the weight of the tubular 60 (and any connected tubing stand or string) is to be held by the top drive (30).

Figure 3A:
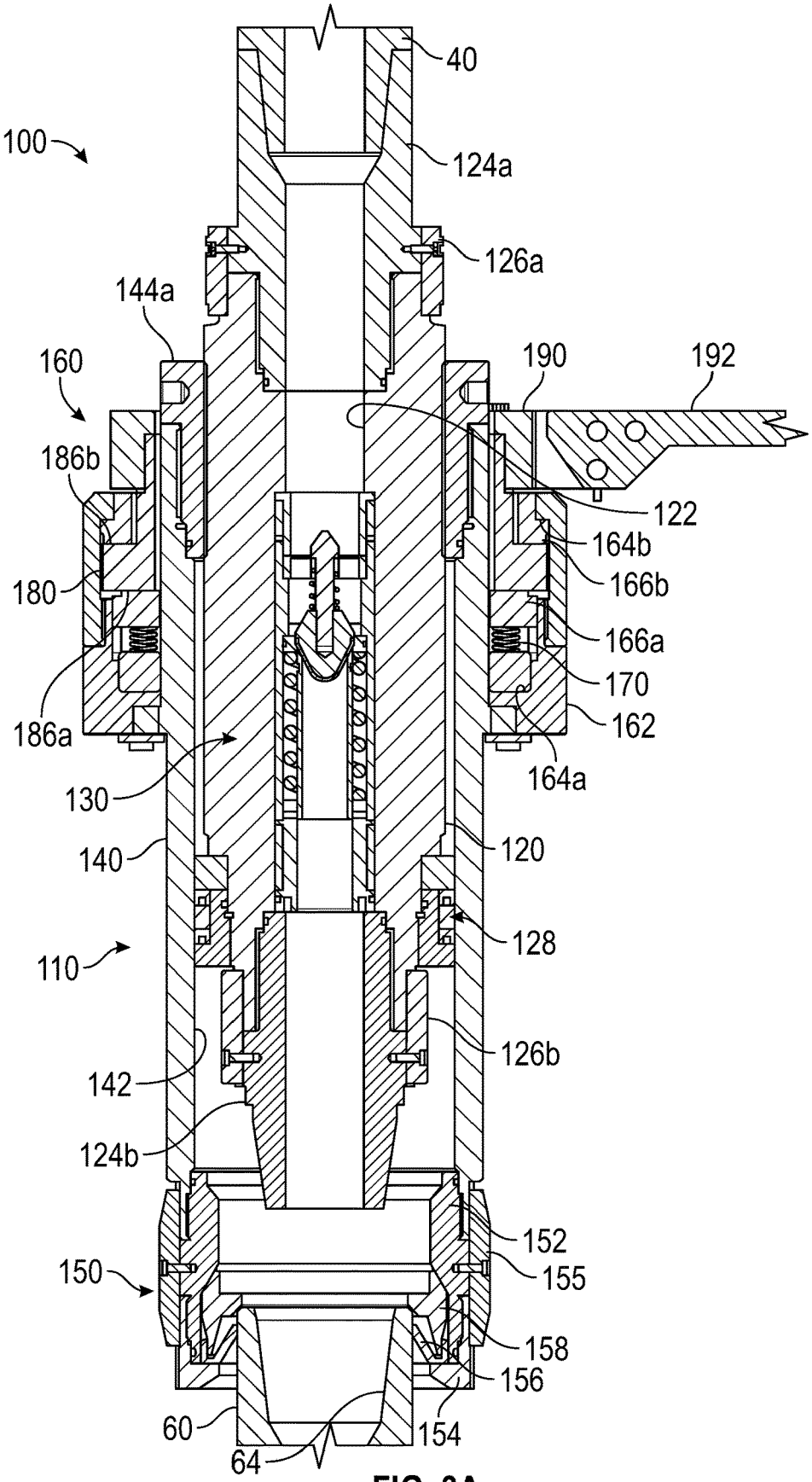
FIG. 3A illustrates a cross-sectional view of the disclosed flowback tool in a condition for fluid connection.
Figure 3B:
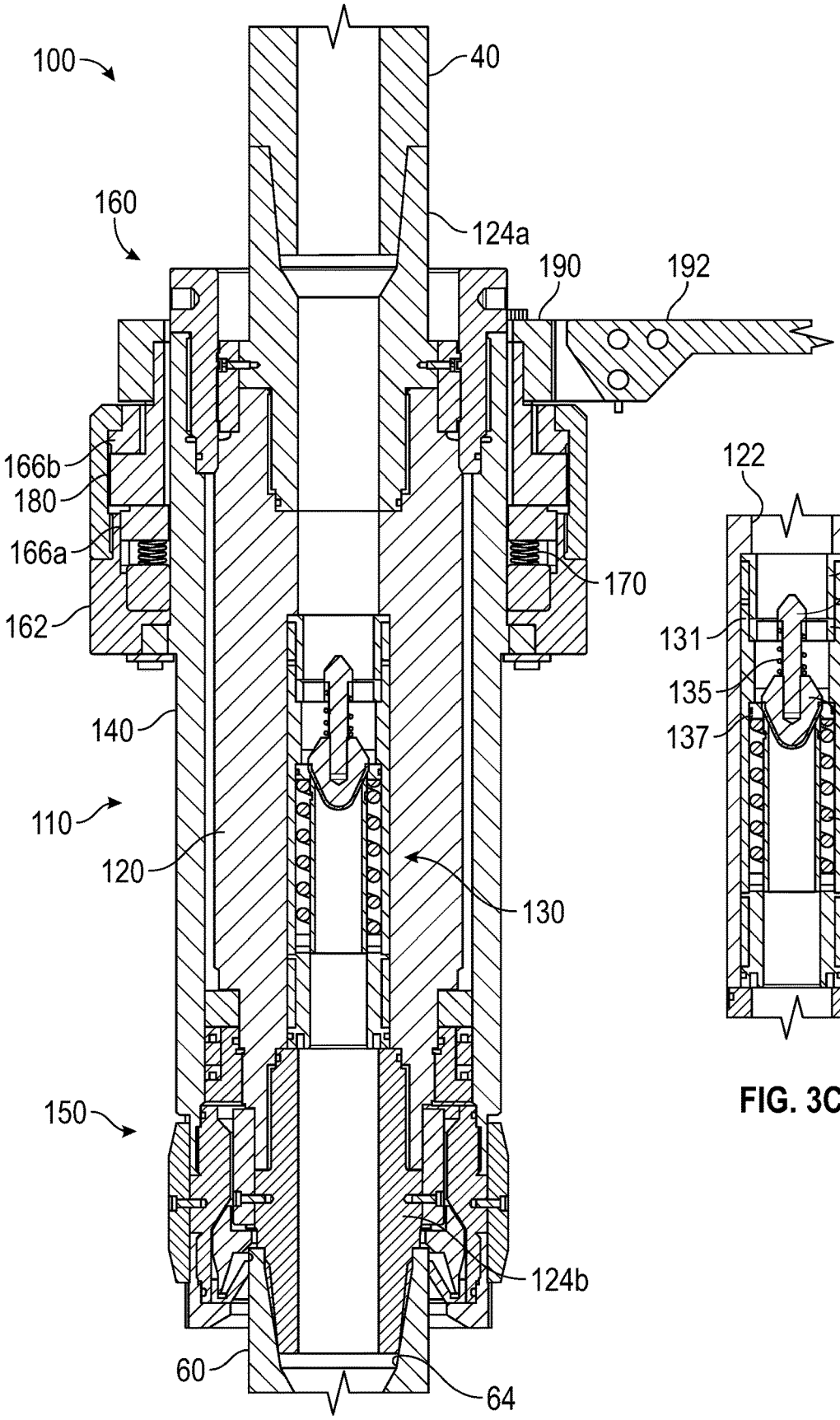
FIG. 3B illustrates a cross-sectional view of the disclosed flowback tool in a condition for mechanical connection.

Turning now to more details of the flowback tool 100, FIG. 3A illustrates a cross-sectional view of a flowback tool 100 in a sealed condition with a tubular 60, and FIG. 3B illustrates a cross-sectional view of the flowback tool 100 in a threaded condition with the tubular 60.

As noted previously, the flowback tool 100 includes a mechanical stroke tool 110 having an inner body or mandrel 120 disposed in an outer body, cylinder, or barrel 140. Also, the flowback tool 100 includes a clutch 160 mounted on the barrel 140.

Looking first at the mandrel 120, a flow passage 122 in the mandrel 120 communicates a connection 124*a* at one end of the mandrel 120 to a coupling 124*b* at the other end of the mandrel 120. The connection 124*a* can be integrated into the mandrel 120 so that the mandrel 120 includes an integrated box connection. Alternatively and as shown here, the connection 124*a* is a top crossover connected to a top end of the mandrel 120. The top crossover 124*a* has a box connection for connection to the quill 40 of the top drive (30). A collar 126*a* can engage with splines on the top crossover 124*a* and the mandrel's top end to prevent rotation of the crossover 124.

The coupling 124*b* on the other end of the mandrel 120 can also be a crossover connected to the bottom end of the mandrel 120. This bottom crossover 124*b* includes a pin connection. In a similar fashion as before, a collar 126*b* can engage with splines on the bottom coupling 124*b* and the mandrel's bottom end to prevent rotation. In an alternative arrangement, features of the bottom crossover 124*b* can be an integral component of the mandrel 120 so that the mandrel 120 includes an integrated pin connection. However, it is preferable that the bottom crossover 124*b* be a replaceable coupling.

The mandrel 120 has a cam engagement with the barrel 140. For example, the outer surface of the mandrel 120 and an inner surface 142 of the barrel 140 can have engaged thread, such as a stub-Acme thread. In operation, rotation in the CW direction retracts the barrel 140, while rotation in the CCW direction extends the barrel 140. As long as the barrel 140 is prevented from rotating, clockwise rotation of the mandrel 120 will move the barrel 140 in one stroke direction, while counterclockwise rotation of the mandrel 120 will move the barrel 140 in the opposite direction. Toward the mandrel's bottom end, the mandrel 120 includes a carrier 128 with seals and a backup stopper for sealing inside the barrel 140.

The bottom end of the barrel 140 has the annular seal 150, which includes a top ring 152, a lip ring 154, a conical seal element 156, and a stop ring 158. The top ring 152 threads onto the barrel 140. The stop ring 158 fits against a wedge shoulder of the top ring 152, and the conical seal 156 fits against an edge of the stop ring 158. Finally, the lip ring 154 threads onto the top ring 152 to hold the stop ring 158 and the seal 156 captive. An outer locking ring 155 having splined engagement can prevent rotation of these components.

The clutch 160 is disposed toward the top end of the barrel 140. In general, the clutch 160 has first and second portions, which define an interface with a torque threshold between them. The first portion generally includes a housing 162 that is fixed on the barrel 140 of the mechanical stroke tool 100. For example, the housing 162 can engage splines and shoulders on the outer surface of the barrel 140. The second portion generally includes a slip ring 180 and a collar 190 disposed on a slip ring 180.

The interface with the torque threshold between these portions (162 & 180, 190) includes brake pads or rings 166*a-b* and one or more biasing elements 170 engaged between surfaces 164*a-b* of the housing 162 and surfaces 186*a-b* of the slip ring 180. Finally, the collar 190 has the anti-rotation arm 192, which can contact a bail to allow extension/retraction of the barrel 140 in a mechanical stroke as noted above. The arm 192 can have an extended condition as shown in which the arm 192 projects radially outward. The arm 192 can also be moved to a retracted condition in which the arm 192 projects downward and will not contact a bail during rotation.

As further shown, the flowback tool 100 includes a mud saver valve 130 disposed internally in the flow bore 122 of the mandrel 120. The mud saver valve 130 can be self-actuated and can be installed in one step as a pre-assembled cartridge into the mandrel's bore 122.

Figure 3C:
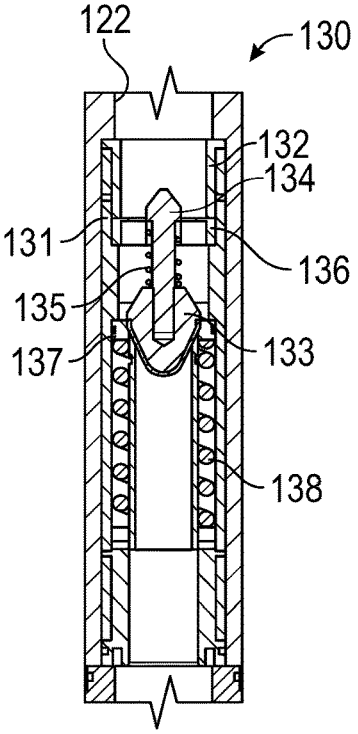
FIG. 3C illustrates a detailed cross-sectional view of the mud saver valve of the disclosed flowback tool.

Details of the mud saver valve 130 can be similar to those disclosed in U.S. Pat. Nos. 8,118,106 and 8,141,642, which are incorporated herein by reference. As shown in the detail of FIG. 3C, the mud saver valve 130 includes a body 131, a sleeve 132, a poppet 133, a stem 134, a poppet spring 135, a baffle 136, a seat 137, and a seat spring 138. As depicted here, the mud saver valve 130 is in a closed position, but can be opened during operations to permit fluid communication through the mandrel's bore 122. In particular, the mud saver valve 130 of the flowback tool (100) can open for filling or circulating fluid and can open for receiving returns.

In a fill or circulation condition, for example, fluid communicated down through the mandrel's bore 122 passes through the baffle 136 and acts against the seat 137, which is biased by the seat spring 138. When the fluid pressure or flow differential overcomes the bias of the seat spring 138, the seat 137 moves away from the poppet 133, which remains extended downhole by the spring 135 on the stem 134. At this point, the fluid for filing or circulating can flow past the mud saver valve 130 and out of the bottom crossover 124*b* of the mandrel 120.

In a reverse flow condition, returns coming up through the mandrel's bore 122 act against the poppet 133, which is biased by the spring 135 on the stem 134. When the fluid pressure or flow differential overcomes the bias of the spring 135, the poppet 133 moves away from the seat 137, which remains shouldered by the body 131 and the cap 132. At this point, the returns can flow up through the mud saver valve 130 and out of the top crossover 124*a* of the mandrel 120. When there is low fluid pressure in either direction, the mud saver valve 130 closes.

Figure 4A:
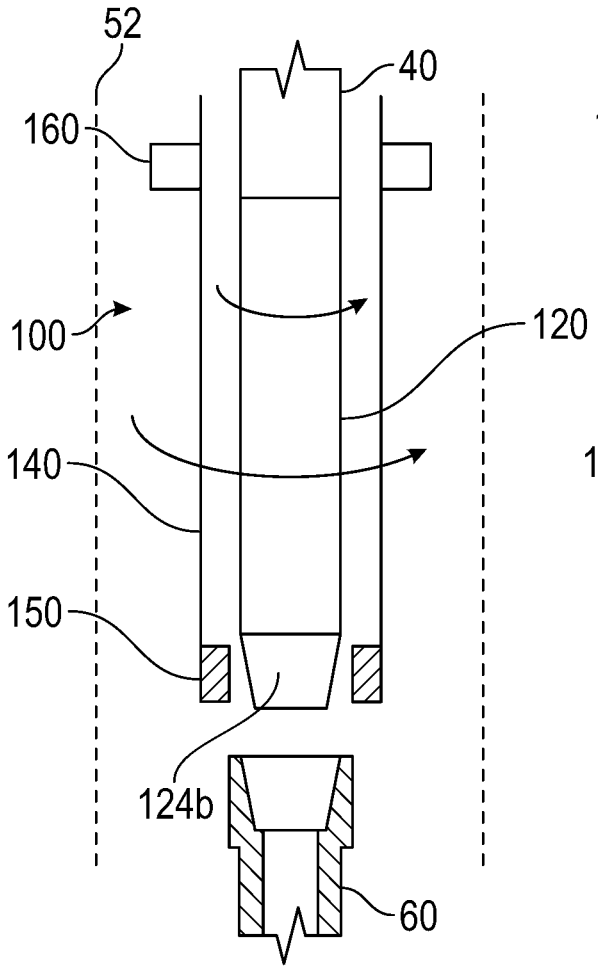
FIGS. 4A-4F illustrate schematic details of the operation of the disclosed flowback tool.
Figure 4B:
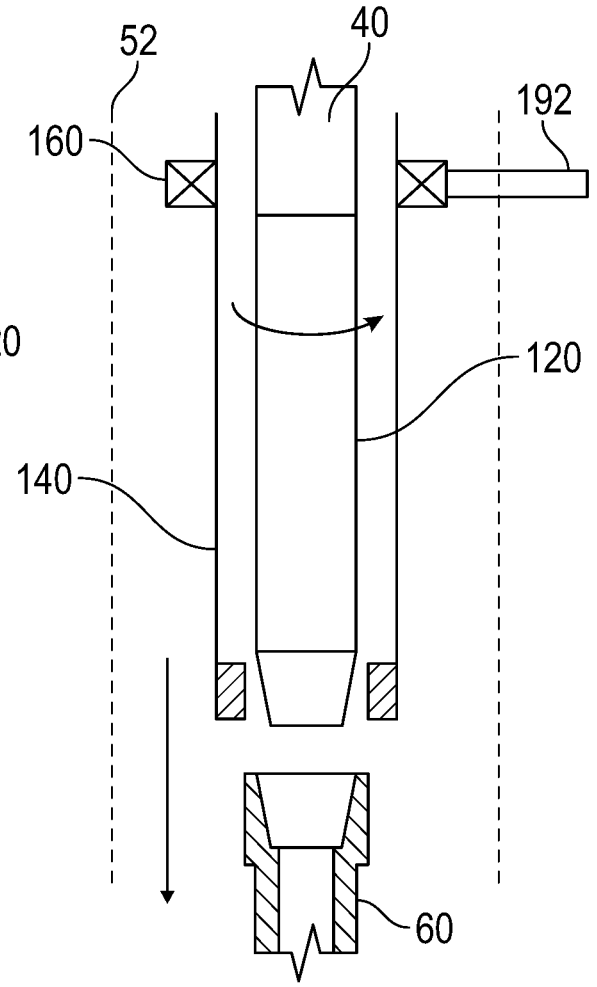
Figure 4C:
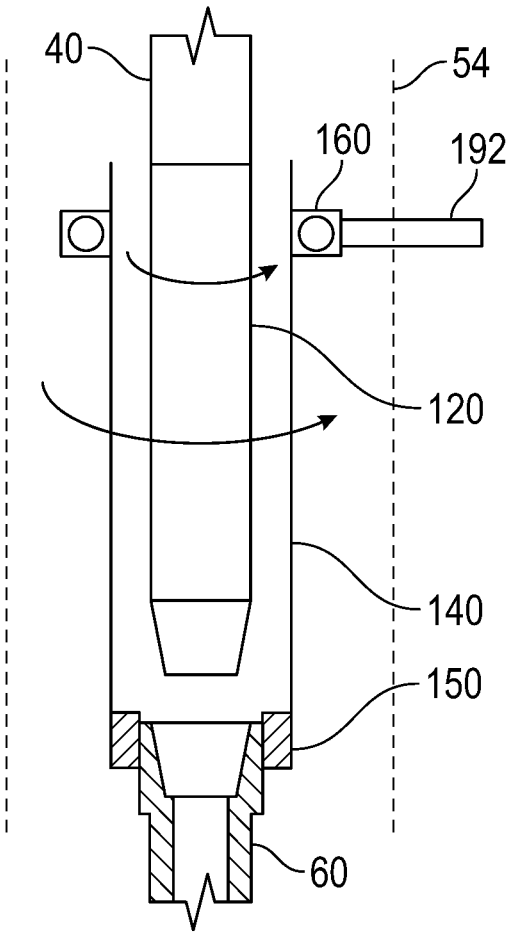

Operation of the flowback tool 100 of FIGS. 3A-3C is now discussed in conjunction with the schematic views in FIGS. 4A-4F. During operations as shown in FIG. 4A, a fluid connection of the flowback tool 100 can be made with the tubular 60 (which can be a joint or stand), which is held in the elevator (54) of the top drive (30). To make the fluid connection, rotation of the top drive's quill 40 operates the mechanical stroke tool 110 by rotating the mandrel 120 in a counterclockwise direction. As shown in FIG. 4B, the anti-rotation arm 192 of the clutch 160 engages a bail (52) of the top drive (30). Now, the rotation of the mandrel 120 then translates to the extension of the barrel 140 toward the end of the tubular 60. Eventually as shown in FIG. 4C, the annular seal 150 of the barrel 140 seals with the end of the tubular 60. The sealed engagement allows for fluid communication between the tubular 60 and the top drive (30) through the flowback tool 100. Slipping of the clutch 190 can prevent over-extension of the barrel 140.

Depending on the stage of rig operations, the fluid communication through the flowback tool 100 can allow the tubular 60 to be filled with drilling fluid, can allow for circulation of drilling fluid through the tubular 60 during advancement of the tubular 60 into the wellbore, and/or can allow any returns displaced during advancement of the tubular into the wellbore to flow up through the flowback tool 100 when the string is lowered into the wellbore.

As generally noted above, the fluid communication is first achieved by partially extending the barrel 140 with the rotation of the top drive (30) so that the annular seal 150 of the barrel 140 seals on the outer diameter of the tubular 60. The driller extends the barrel 140 until the anti-rotation arm 192 reaches the bail marking (53*a-b*). As shown in more detail in FIG. 3A, the conical sealing element 156 engages around the outer diameter of the tubular 60, and the end of the tubular 60 engages the stop ring 158. Fluid can pass between the mandrel's bore 122 and the tubular 60 with the intermediate space in the cylinder's interior 142 sealed by the mandrel's seal 128 to the barrel 140 and by the cylinder's annular seal 150 to the tubular 60.

In addition to the fluid connection, a mechanical connection of the flowback tool 100 can be made with the tubular 60 during operations. For example, the stand (61) having tubular 60 may be ready to be made up with a tubing string (62) on the rig (10) so the tubing string (62) can then be advanced into the wellbore. The mechanical connection may be made during well control operations or when the weight of the tubing string is to be supported. The load rating for the mechanical connection can be up to 1500 tons (depending on connection size and grade selected).

One of the occasions where it may be required to apply torque on the rotation higher than the brake torque for the clutch 160 is during a well control situation. Another occasion is when the weight of the tubing string (62) is to be supported. For well control, for example, it is necessary to make up the flowback tool 100 to the tubular's box connection 64 via the threads on the mandrel's bottom crossover 124*b*. Accordingly, the mechanical connection can be used to handle a well control event, such as a kick or underbalanced pressure situation, or to support string weight.

In the mechanical connection as shown in FIG. 3B, the bottom crossover 124*b* of the mandrel 120 can be connected to the box connection 64 of the tubular 60. This is achieved by fully retracting the barrel 140.

Figure 4D:
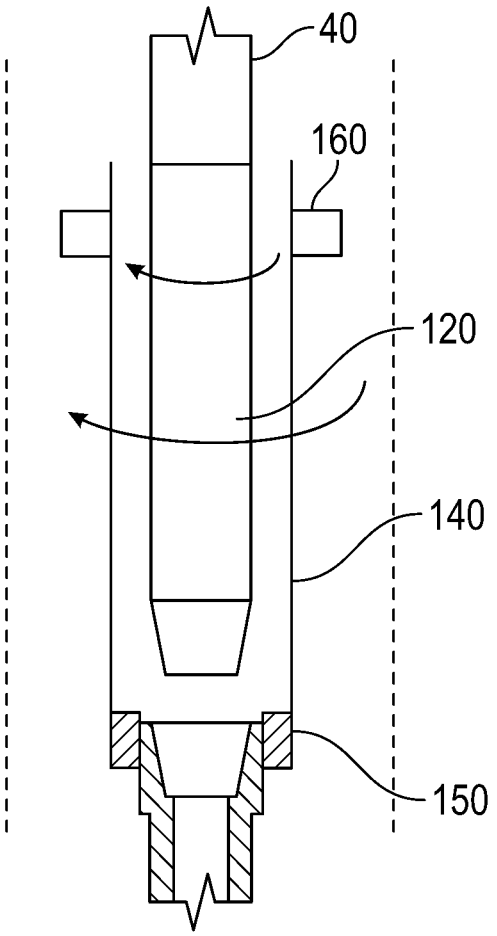
Figure 4E:
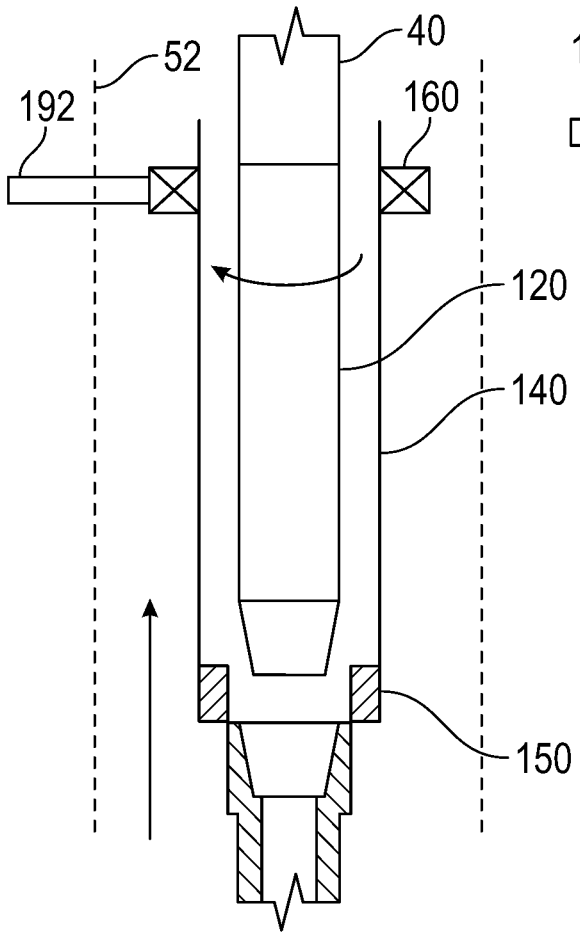
Figure 4F:
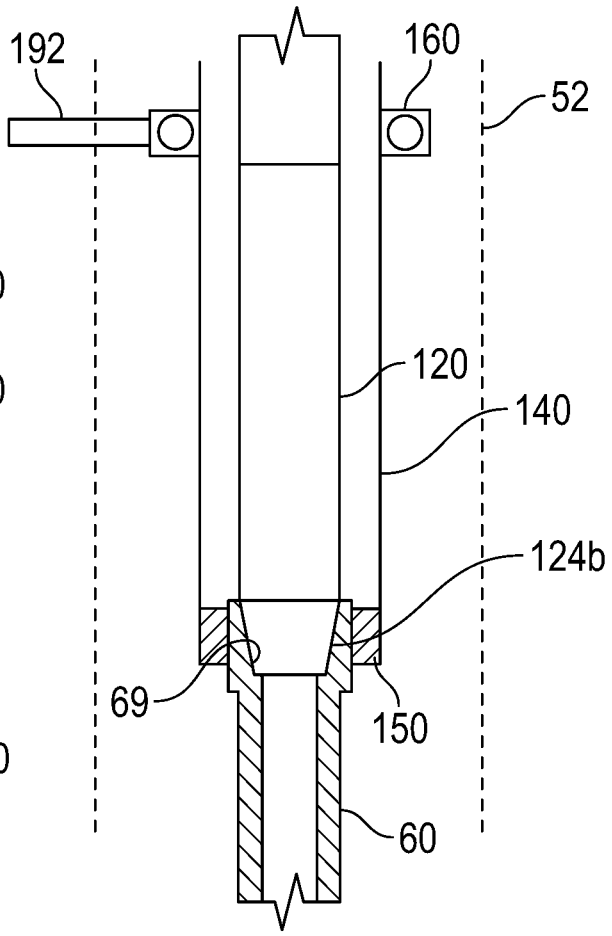

As schematically shown in FIGS. 4D-4E, for example, the barrel is retracted with CW rotation. Eventually, further retraction of the barrel 140 is stopped, such as when the barrel 140 hits an upper stop on the mandrel 120. If permitted, the barrel 140 would then rotate with the CW rotation of the mandrel 120. As the top drive's quill 40 continues rotation in the CW direction, the torque applied to the rotation will overcome the brake torque in the clutch 160 so the barrel 140, even though it cannot retract further, can continue to rotate with the mandrel 120. Then as shown in FIG. 4F, the coupling 124*b* on the mandrel 120 can be threaded into the box connection 64 of the tubular 60 without damaging the stub-acme threads for the pin and box connections. The annular seal 150 remains engaged with the tubular 60.

With the additional sealing afforded by the threaded connection between the coupling 124*b* and the box connection 64 as shown in FIG. 3B, fluid circulation can be made from the top drive (30) to the tubular 60, and any necessary actions can be taken to control pressure. For example, heavyweight mud or kill fluid can be circulated through the connection until the annulus of the wellbore is filled with the kill fluid or circulation of the wellbore with drilling fluid until the kick subsides. Further, if necessary, a well control valve in the top drive (30) can be closed.

During the fluid and mechanical connection, the tubular 60 may then be advanced into the wellbore until another tubular (joint or stand) needs to be added. Further, the mechanical connection allows for the tubular 60 to be rotated while being advanced.

As shown in FIGS. 3A-3B and described above, the clutch 160 allows the driller to over-rotate the quill 40 of the top drive (30) without causing damage to the tool 100 in either direction. The clutch 160 includes upper and lower brake pads 166*a-b*. These brake pads 166*a-b* engage the slip ring 180, which is mechanically connected by the collar 190 to the anti-rotation arm 192, which can contact with the top drive's bails (52). The clutch 160 has a spring mechanism having one or more biasing elements 170 to adjust the brake force created in the clutch 160. The one or more biasing elements 170 can be Belleville discs or compression springs mounted in the clutch's housing 160. The biasing elements 170 are mounted on a push plate that can be adjusted upward or downward in the housing 162 by tightening a set of screws 163 threaded into the clutch's housing 162. The tighter the screws get the higher the friction force becomes in the clutch 160.

The clutch's housing 162 is mounted on the mechanical stroke barrel 140 that moves axially (up or down) by the action of the top drive's quill rotation. The barrel 140 has a predefined travel or stroke on the mandrel 120. The mandrel 120 has an external thread (stub-acme or similar), and the barrel 140 has an internal thread that engages with the mandrel 120. The mandrel 120 is connected to the top drive's quill 40 using a threaded connection 124*a*. When the top drive's quill 40 rotates, then the mandrel 120 rotates with it as one component. When the rotation arm 192 is extended and contacts the top drive's bail (52), the barrel 140 will start moving up or down depending on the direction of the quill's rotation (CW or CCW).

Once the driller reaches the end of the stroke of the barrel 140 by rotating the quill 40, the barrel 140 will hit a stop where it cannot move further up or down (depending on the direction). The slip ring 180 will slip in the rotational direction inside the clutch 160 once the brake force in the pads 166*a-b* has been reached. At this point, the mandrel 120 and the barrel 140 will rotate together but without any axial movement from the barrel 140. This will prevent any damage to the internal and external threads on the barrel 140 and mandrel 120 respectively.

As noted in the Background of the present disclosure, existing designs rely on the driller watching the visual indicators 53*a-b* to stop the quill's rotation once the maximum and minimum stroke positions have been reached. The existing designs do not provide any safety mechanism to prevent damage to the mechanical stroke tool 110 when the quill 40 is over-rotated by the driller. However, the clutch 160 disclosed herein allows the driller to over-rotate the quill 40 without causing any damage to the mechanical stroke tool 110. The clutch 160 allows rotation of the arm 192 when torque on the top drive (30) is exceeded to screw in the mandrel's bottom coupling 124*a* with the tubular 60, which can be done to perform well control operators or to hold the weight of the tubular 60 as already noted.

In general and as discussed in more detail below, the clutch 160 can have a wet design or a dry design. In the wet design, the internal components are submerged in oil. This wet design allows temperatures to be kept low when the slip ring 180 slips with respect to the brakes 166*a-b*. Also, the wet design of the clutch 160 can reduce noise and prolong wear in the brakes 166*a-b*. The dry design does not use oil in the clutch 160. The dry design clutch can provide a better friction coefficient with less preload on the biasing element 170 considering that there is no oil in contact with the brakes 166*a-b*.

Figure 5:
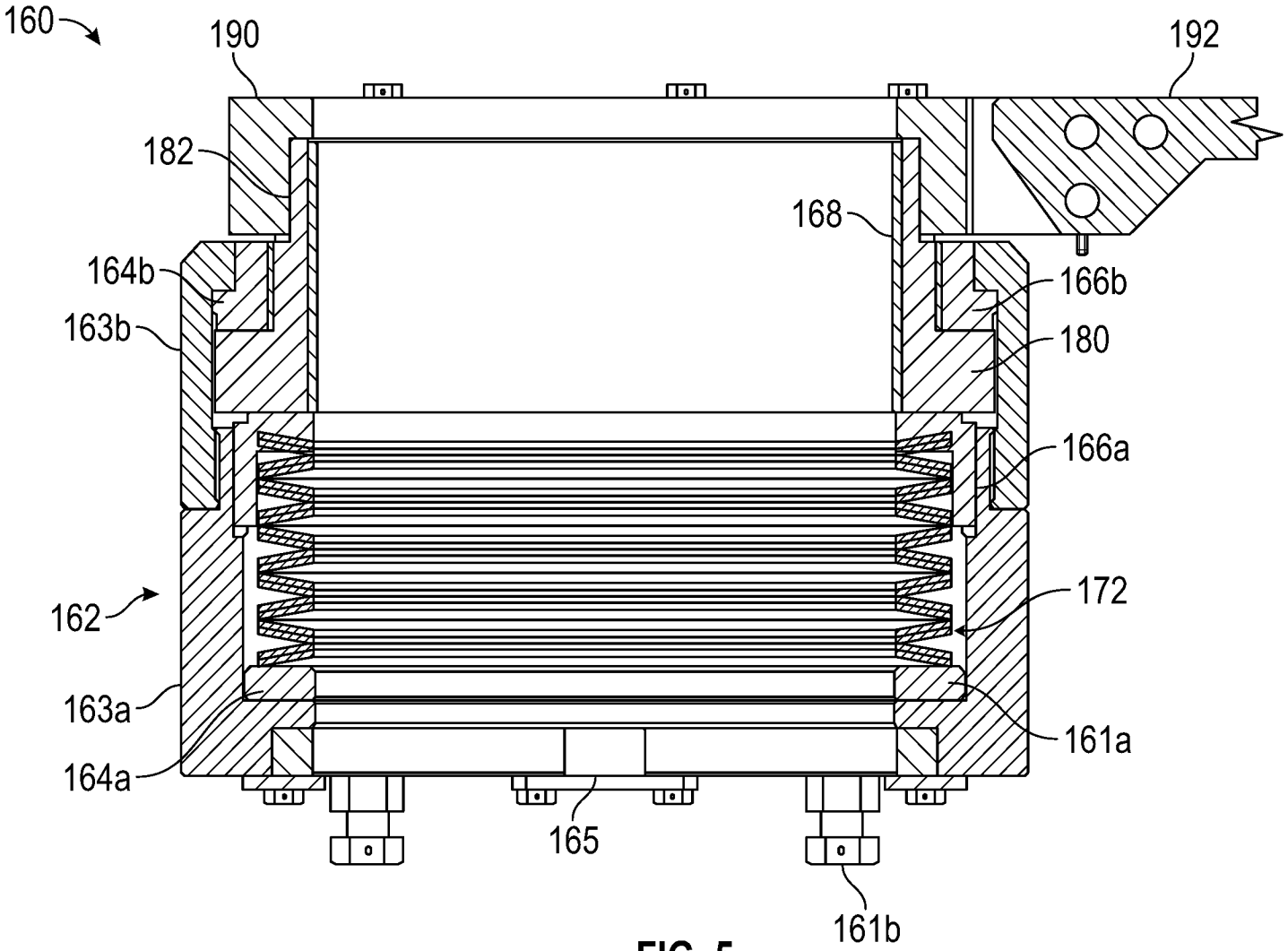
FIG. 5 illustrates a cross-sectional view of a first embodiment of a clutch for the flowback tool.

Having an understanding of how the clutch 160 operates, further details of the clutch 160 are now described. FIG. 5 illustrates a cross-sectional view of a first embodiment of a clutch 160 for the flowback tool (100). The clutch 160 includes a housing 162, a push ring 161*a*, biasing elements 172, a lower brake pad 166*a*, a slip ring 180, an upper brake pad 166*b*, and a collar 190. For further illustration, FIGS. 5A-5B illustrate perspectives view of the upper brake pad 166*b* and the lower brake pad 166*a*, respectively.

In this embodiment, the clutch 160 uses Belleville springs 172 for the biasing elements. The housing 160 has a lower internal shoulder 164*a* and an upper internal shoulder 164*b*. (For assembly purposes, the housing 162 can have two housing portions 163*a-b* that couple together.) Locking tabs 165 on the inner lower end of the housing 162 can engage splines of the barrel (140), as shown in FIGS. 3A-3B. Consequently, rotation of the barrel (140) therefore translates to the rotation of the housing 162.

Inside the housing 162, the push ring 161*a* is supported on the lower internal shoulder 164*a*, and the Belleville springs 172 are stacked inside the housing 162 on the push ring 161*a*. The lower brake pad 166*a* fits inside the housing 162 and is biased by the stacked Belleville springs 172 away from the lower internal shoulder 164*a*. The slip ring 180 fits in the housing 162, and a brass bushing 168 can fit inside the slip ring 180.

The slip ring 180 has a lower surface 186*a* engaged by the lower brake pad 166*a*. The upper brake pad 166*b* fits on the slip ring 180 and engages an upper surface 186*b* of the slip ring 180. The upper inner shoulder 164*b* of the housing 162 (i.e., the upper housing portion 163*a*) then fits against the upper brake pad 164*b*. Adjustment screws 161*b* at the bottom of the housing 162 can be adjusted to move the push ring 161*a* and can change the bias of the springs 172. A preload is applied to the Belleville springs 172 by rotating the adjustment screws 161*b* that push the plate 161*a* upward to increase the force acting on the brakes 166*a-b*. In turn, the brakes 166*a-b* (upper and lower) compress against the slip ring 180 attached to the rotation collar 190 and arm 192, thereby making it harder to rotate around the axis unless the torque applied overcomes the brake torque created by the brakes 166*a-b* and the preload of the springs 172.

Figure 6A:
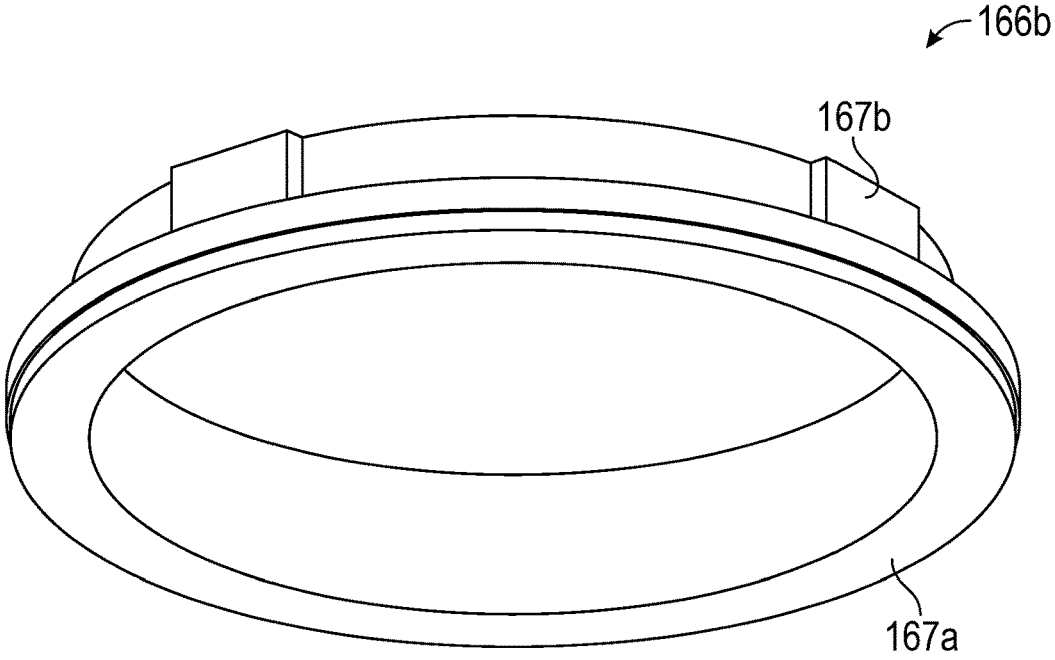
FIG. 6A illustrates a perspective view of an upper brake pad for the clutch of FIG. 5.
Figure 6B:
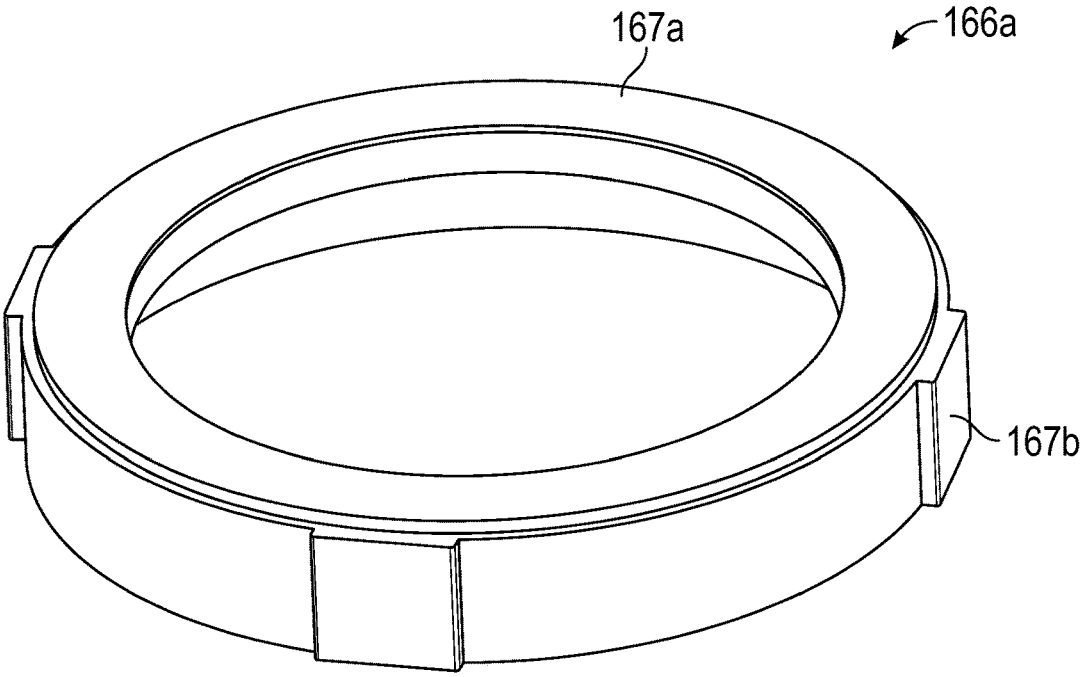
FIG. 6B illustrates a perspective view of a lower brake pad for the clutch of FIG. 5.

The upper and lower brake pads 166*a-b*, as best shown in FIGS. 6A-6B, have hardened surfaces 167*a* for friction engagement. The brake pads 166*a-b* also have external spines 167*b* thereabout that engage with the housing (162) and prevent rotation of the pads 166*a-b* separate from the housing (162).

Finally as shown in FIG. 5, the upper collar 190 fits on splines 182 on an upper end of the slip ring 180 so that the two rotate together. The anti-rotation arm 192 extends from the collar 190 and is shown here protruding radially outward to engage a bail (52) of the top drive (30). Bolts, locking pins, or the like can be used to hold the arm 192 in position on the collar 190, but may allow for the arm 192 to be switched to project in a downward position.

As the barrel (140) rotates on which the clutch 160 is held, the housing 162 rotates, as do the brake pads 166*a-b*. The anti-rotation arm 192, although it may originally rotate, engages against a bail (52), which prevents its further rotation. As a result, the slip ring 180 connected by the splines 182 to the collar 190 for the anti-rotation arm 192 stops turning with the rotation of the barrel (140) and housing 162. Instead, the opposing brake pads 166*a-b* biased against the upper and lower surfaces 186*a-b* of the slip ring 180 ride against them, and the friction acts against the rotation of the cylinder (140) and housing 162. Depending on the bias and the friction, the barrel (140) can be torqued an amount against the clutch 160 so that rotation of the barrel (140) by the top drive (30) can be stopped.

Figure 7:
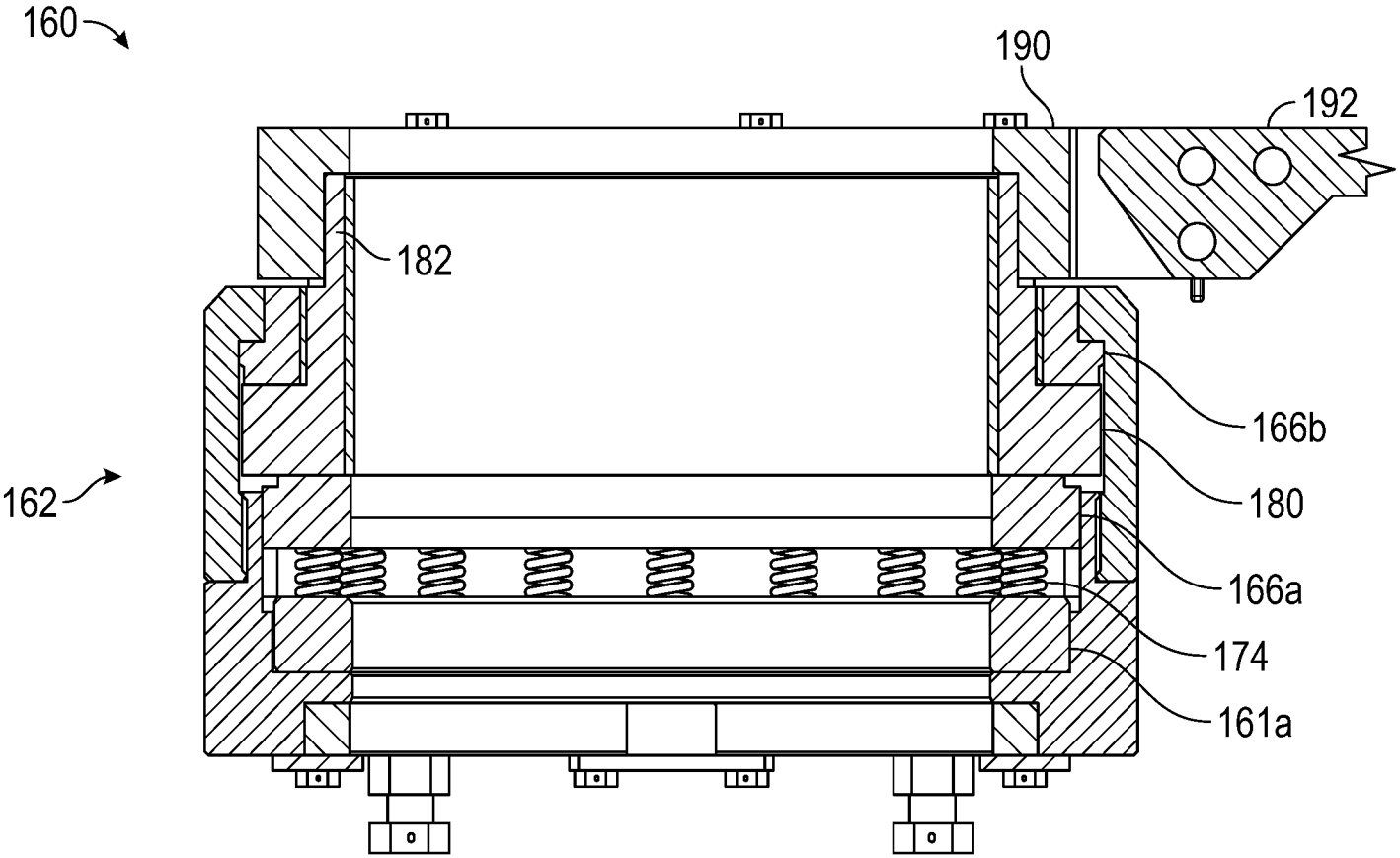
FIG. 7 illustrates a cross-sectional view of a second embodiment of a clutch for the flowback tool.
Figure 8A:
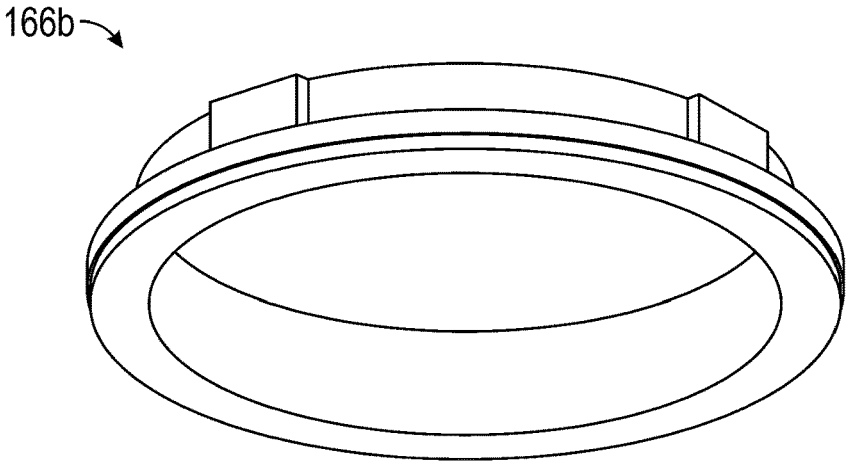
FIG. 8A illustrates a perspective view of an upper brake pad for the clutch of FIG. 7.
Figure 8B:
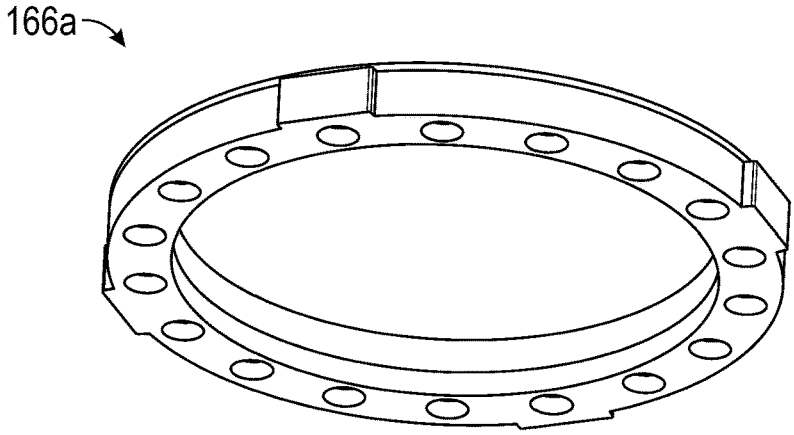
FIG. 8B illustrates a perspective view of a lower brake pad for the clutch of FIG. 7.
Figure 8C:
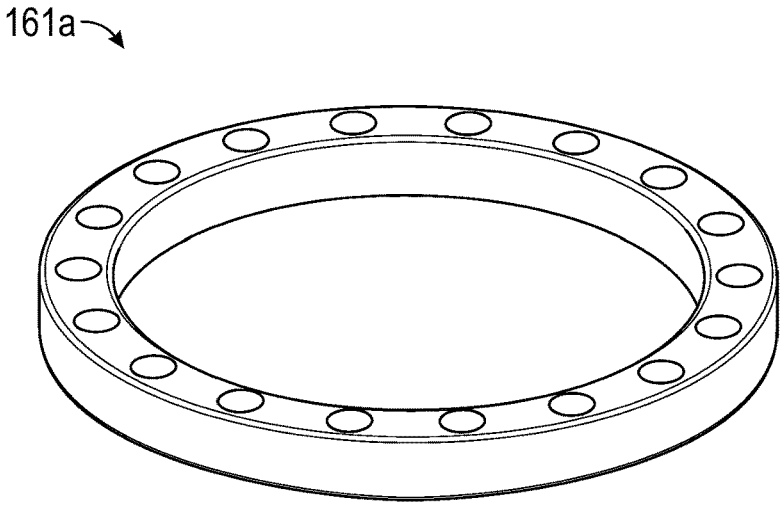
FIG. 8C illustrates a perspective view of a push ring for the clutch of FIG. 7.

FIG. 7 illustrates a cross-sectional view of a second embodiment of a clutch 160 for the flowback tool (100). Again, the clutch 160 includes a housing 162, a push ring 161*a*, biasing elements 174, a lower brake pad 166*a*, a slip ring 180, an upper brake pad 166*b*, and a collar 190. For further illustration, FIGS. 8A-8C illustrate perspective views of the upper brake pad 166*b*, the lower brake pad 166*a*, and the push ring 161*a*, respectively.

This arrangement is similar to that disclosed above with reference to FIG. 5. In this second embodiment of FIG. 7, the clutch 160 uses compression springs 174 for the biasing elements. The compression springs 174 are disposed about the circumference of the push ring 161*a* and the lower brake pad 166*a*. To accommodate the springs 174, opposing slots can be provided in the push ring 161*a* and lower brake pad 166*a*, as best shown in FIGS. 8B-8C.

Figure 9:
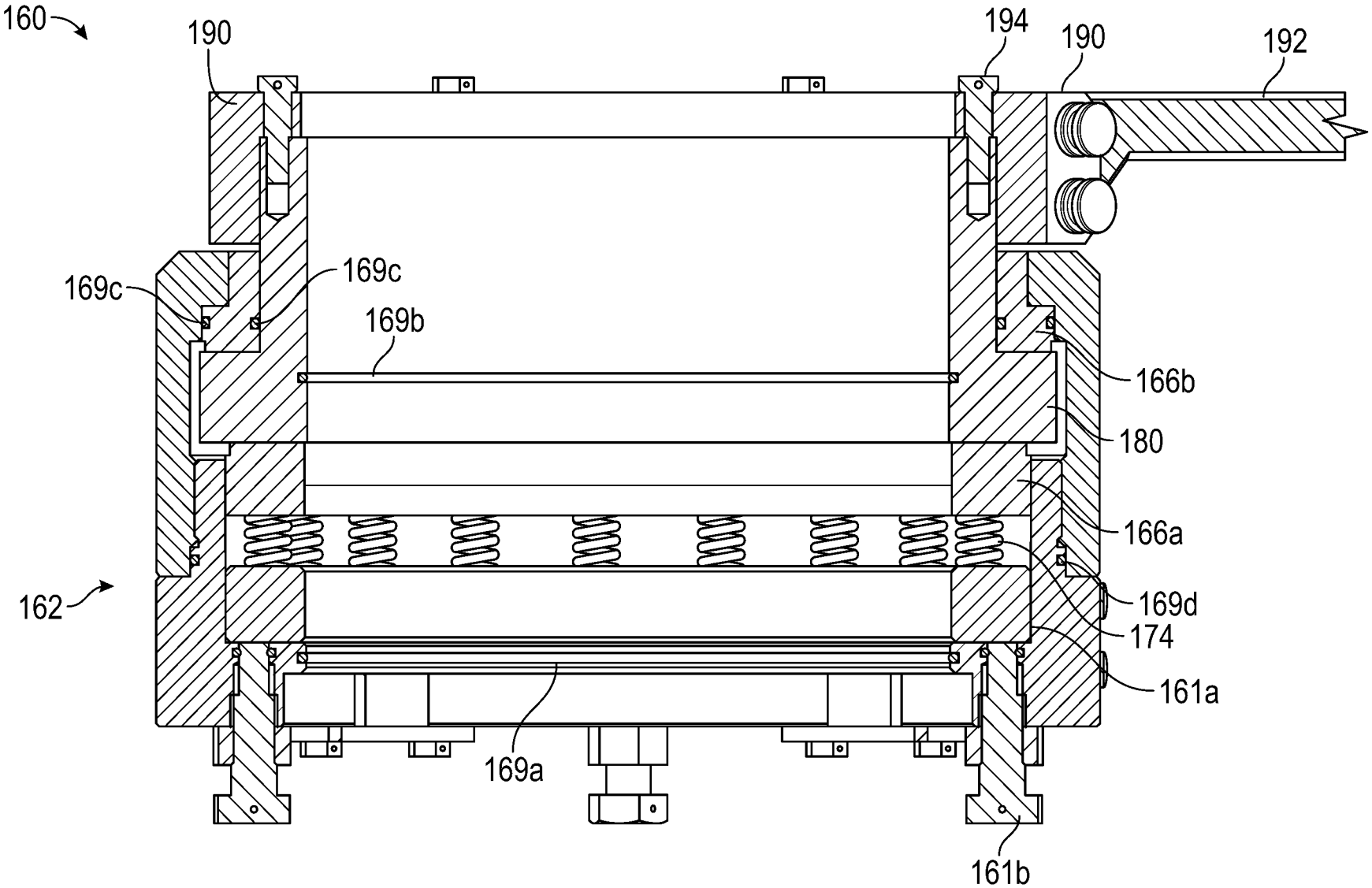
FIG. 9 illustrates a cross-sectional view of a third embodiment of a clutch for the flowback tool.
Figure 10A:
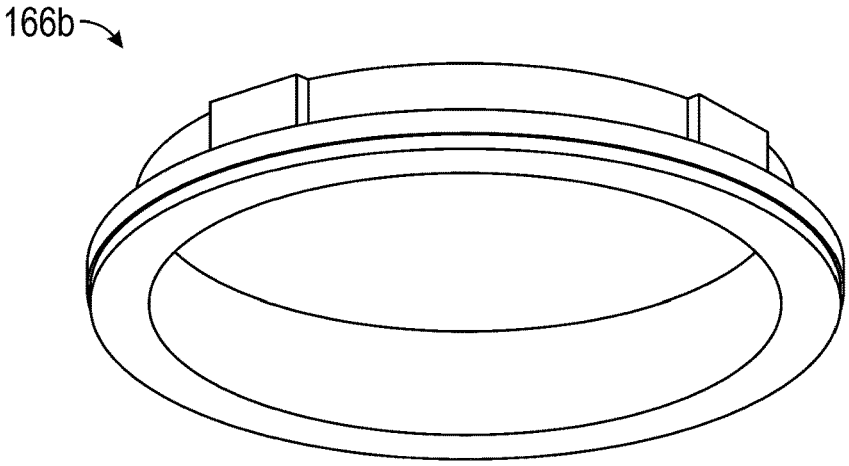
FIG. 10A illustrates a perspective view of an upper brake pad for the clutch of FIG. 9.
Figure 10B:
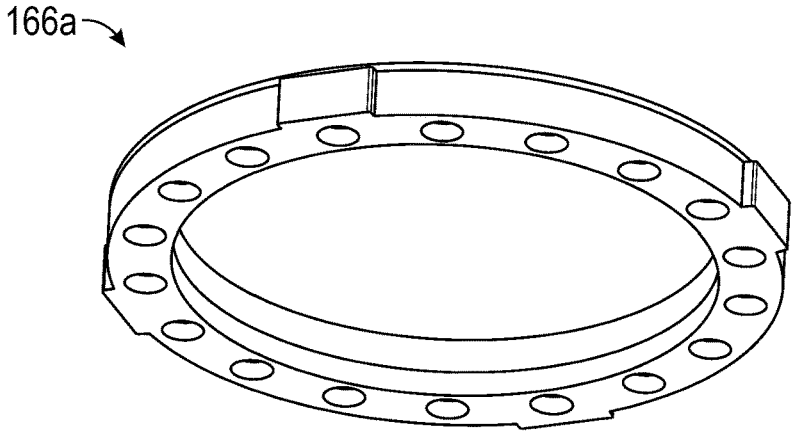
FIG. 10B illustrates a perspective view of a lower brake pad for the clutch of FIG. 9.
Figure 10C:
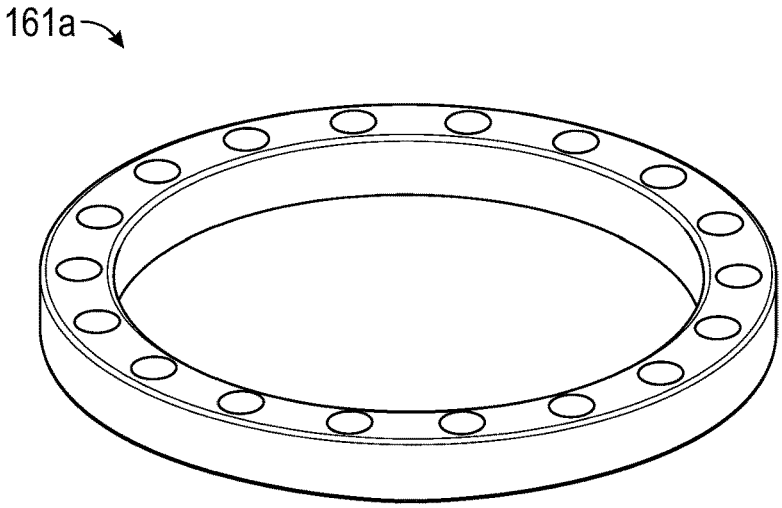
FIG. 10C illustrates a perspective view of a push ring for the clutch of FIG. 9.

FIG. 9 illustrates a cross-sectional view of a third embodiment of a clutch 160 for the flowback tool (100). Again, the clutch 160 includes a housing 162, a push ring 161*a*, biasing elements 170, a lower brake pad 166*a*, a slip ring 180, an upper brake pad 166*b*, and a collar 190. For further illustration, FIGS. 10A-10C illustrate perspective views respectively of the upper brake pad 166*b*, the lower brake pad 166*a*, and the push ring 161*a*.

In the third embodiment, the clutch 160 again uses compression springs 174, but other biasing elements can be used. This arrangement is similar to that disclosed above with reference to FIG. 7. The internal members of the clutch 160 are submerged in oil for a wet clutch design. The oil can reduce the heat and noise when the brake force is overcome by the rotation of the top drive quill. To contain the oil, an O-ring seal 169*a* is provided on the inside of the housing 160 to engage the barrel (140), and another O-ring seal 169*b* is provided on the inside of the slip ring 180 to engage the barrel (140). Additionally, the upper brake pad 166*a* has inner and outer O-ring seals 169*c* to contain oil in the clutch cavity. The housing portions 163*a-b* also have a seal 169*d*. A port can be used to fill the clutch cavity with oil, and the oil can be drained by removing one or more adjustment screws 161*b*. The holes for the adjustment screws 161*b* in the wet design also have an O-ring seal to prevent drainage of the chamber. As opposed to splines between the top collar 190 and the slip ring 180, the use of locking pins 194 is shown as an alternative. (Although not shown, the arrangement of the clutch 160 in FIG. 5 can be similarly configured with an oil cavity to contain oil.)

Figure 11:
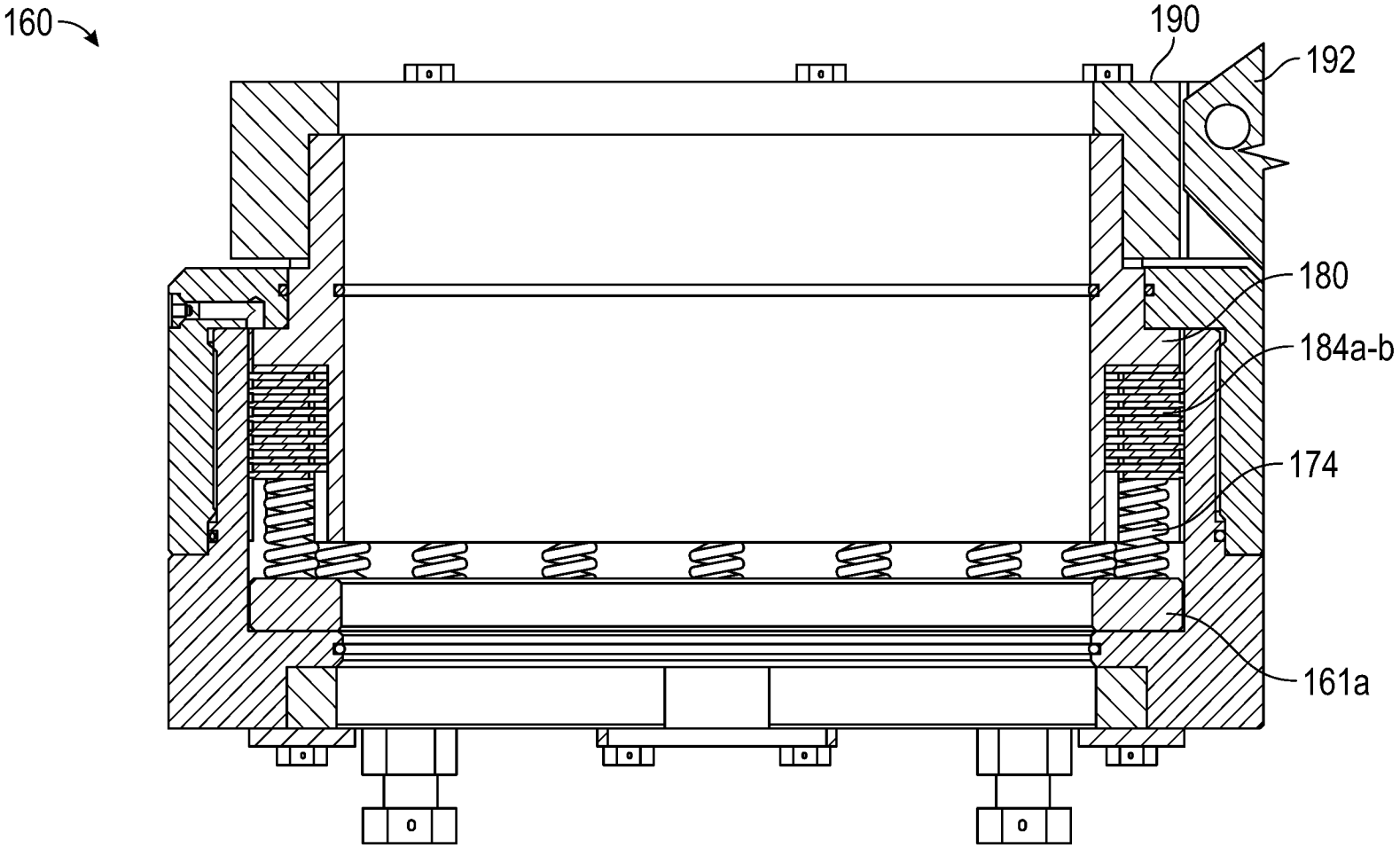
FIG. 11 illustrates a cross-sectional view of a fourth embodiment of a clutch for the flowback tool.

FIG. 11 illustrates a cross-sectional view of a fourth embodiment of a clutch 160 for the flowback tool (100). Again, the clutch 160 includes a housing 162, a push ring 161*a*, biasing elements 170, a lower brake pad 166*a*, a slip ring 180, an upper brake pad 166*b*, and a collar 190. For further illustration, FIGS. 12A-12D illustrate perspective views of the slip ring 180, an inward-engageable stack plate 184*a*, an outward-engageable stack plate 184*b*, and the bottom housing portion 163*a*.

In the fourth embodiment, the clutch 160 gain uses compression springs 174, but other biasing elements can be used. The compression springs 174 are arranged between the push ring 161*a* and the stack plates 184*a-b*, and they work under the same basic principle as the previous embodiments. As shown, however, the clutch 160 uses a set of alternating stack plates 184*a-b* that create part of the brake force for this application.

Figure 12A:
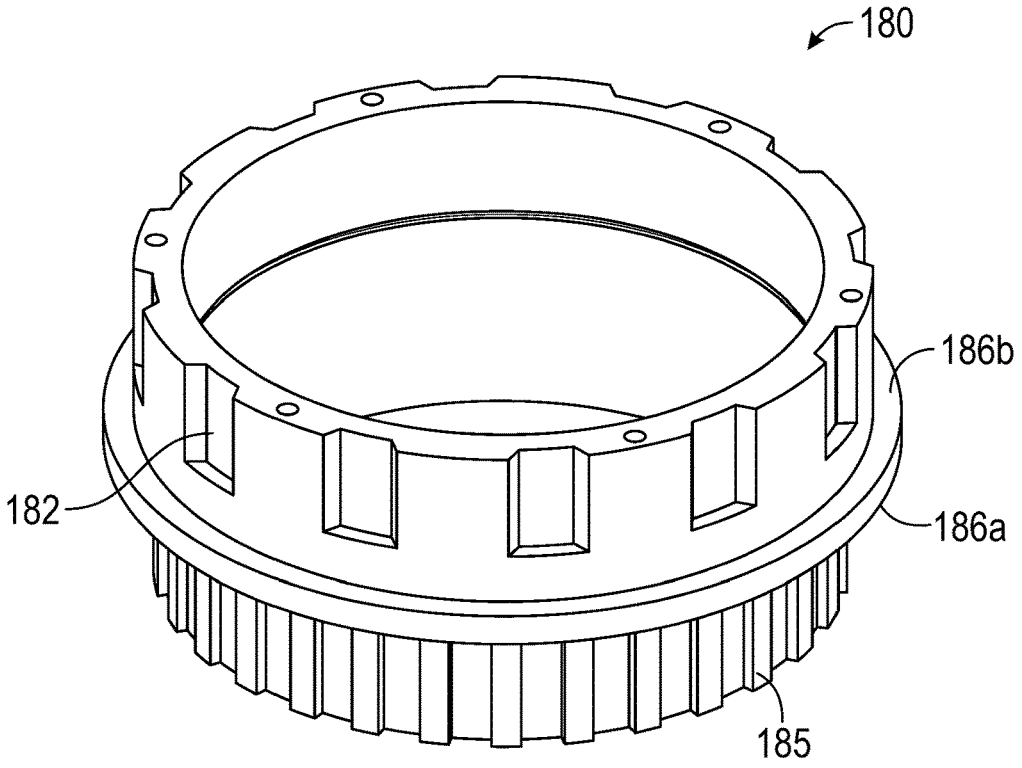
FIG. 12A illustrates a perspective view of a slip ring for the clutch of FIG. 11.

The stack plates 184*a-b* can be composed of the same or different materials. For example, the stack plates 184*a* of FIG. 12B can be steel rings. These steel plates 184*a* are arranged to engage inward with splines 185 as shown in FIG. 12A on the slip ring 180. Alternating between these steel plates 184*a*, the other stack plates 184*b* of FIG. 12C can be brake discs. These brake discs 184*b* are arranged to engage outward with the splines 185 as shown in FIG. 12D on the inside of the lower housing portion 163*a*.

In addition to adjusting the push ring 161*a* with the adjustment screws 161*b* to change the bias of the compression springs 174, the clutch 160 can also be adjusted by adding more sets of steel plates 184*a* and brake discs 184*b* in the assembly. This capability expands the adjustment range for the clutch 160 by selecting multiple combinations and added flexibility by using the adjustment screws to vary the brake force as well.

As before, the internal members of the clutch 160 can be submerged in oil to reduce heat and noise when the brake force is overcome by the rotation of the top drive quill. Seals 169*a-b* are included to create a clutch cavity for the oil. A port is provided to fill the clutch cavity with oil, and the oil can be drained by removing one or more adjustment screws 161*b*. (As will be appreciated, the arrangement of the clutch 160 in FIG. 11 can use Bellville springs (172) as in FIG. 5 or another form of biasing element.)

Figure 12B:
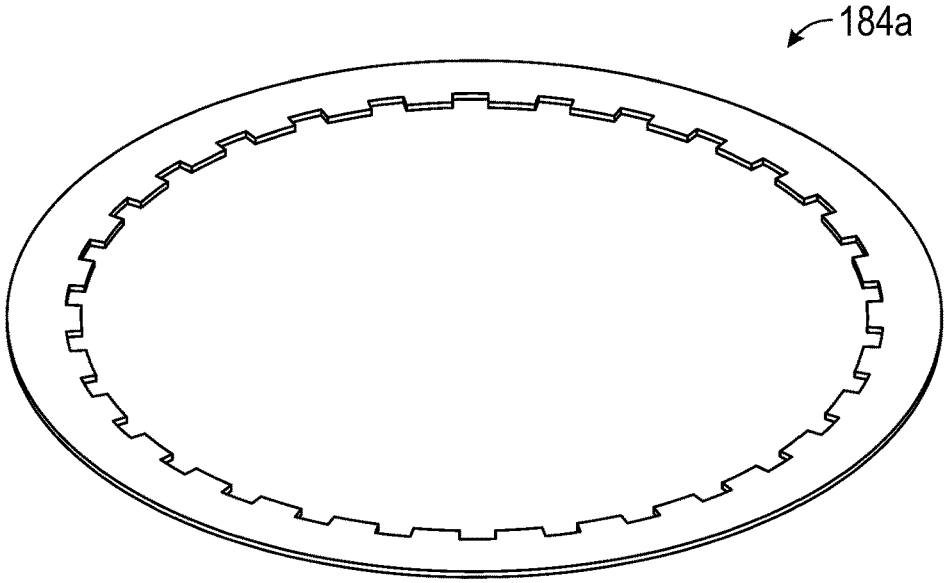
FIG. 12B illustrates a perspective view of an inward-engageable stack plate for the clutch of FIG. 11.
Figure 12C:
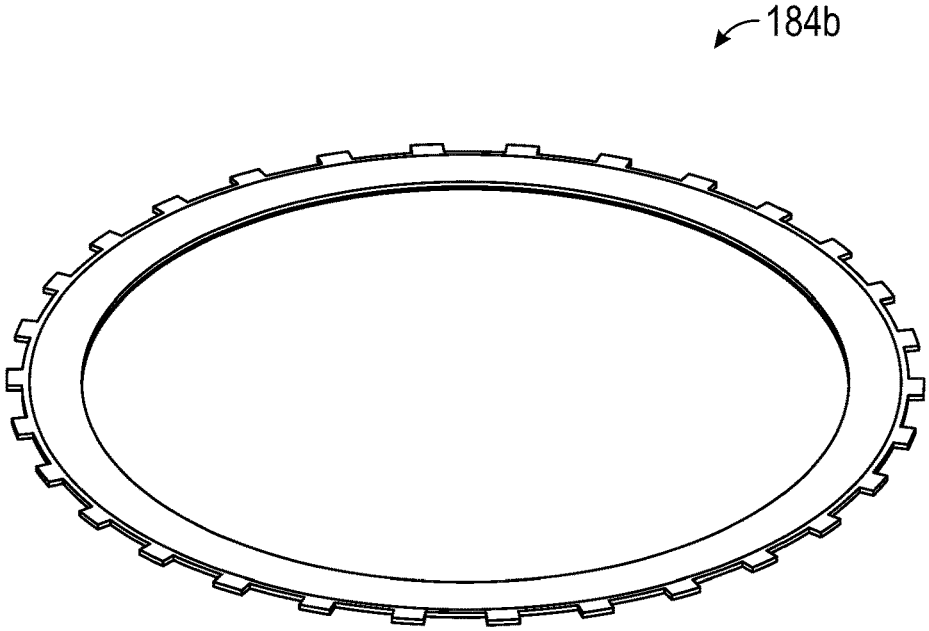
FIG. 12C illustrates a perspective view of an outward-engageable stack brake pad plate for the clutch of FIG. 11.
Figure 12D:
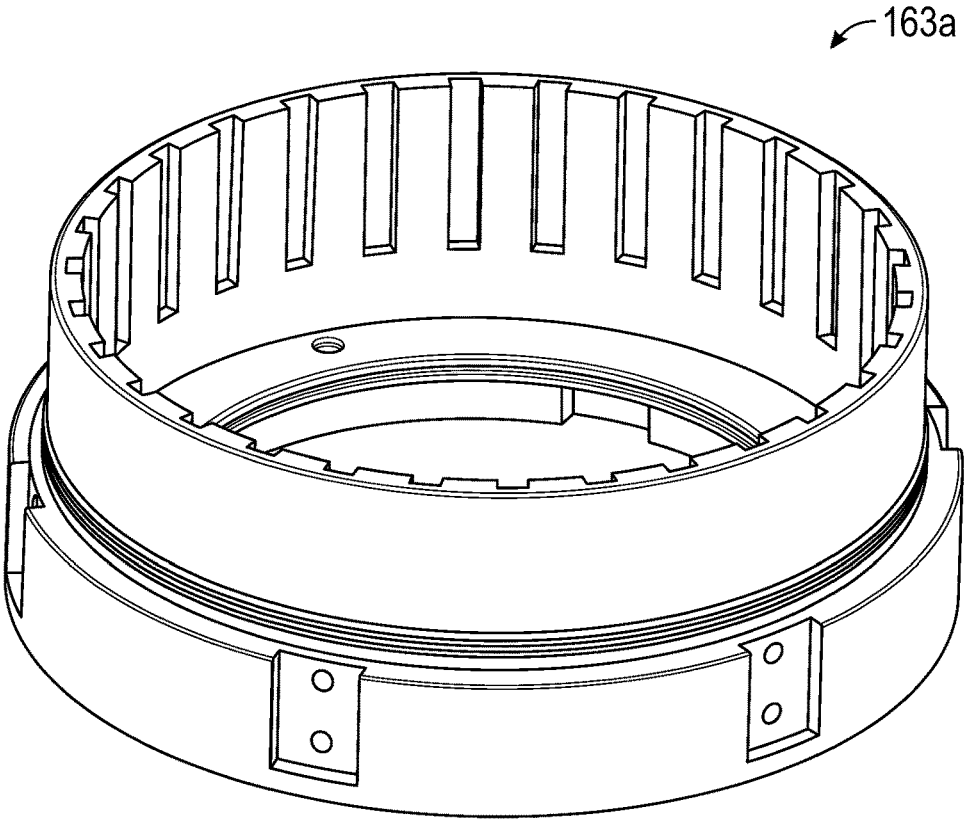
FIG. 12D illustrates a perspective view of a bottom housing portion of the clutch of FIG. 11.

The slip ring 180 in FIG. 12A has an external splined profile 185 that engages with the steel plates 184*a*, which have an internal spline profile as shown in FIG. 12B. This allows the slip ring 180 and the steel plates 184*a* to rotate together. The lower housing portion 163 in FIG. 12D has an internal splined profile that engages with the brake discs 184*b*, which have an external splined profile as shown in FIG. 12C. This allows the housing portion 163*a* and the brake discs 184*b* to remain as one fixed assembly without relative movement between them.

During operations, the compression springs 174 compress the plates 184*a* and the brake discs 184*b* creating a high friction force (brake torque). There will be relative angular movement between the brake discs 184*b* and the steel plates 184*a* only when the torque applied to the rotation arm 192, collar 190, and slip ring 180 is higher than the brake torque created by the clutch 160.

Figure 13:
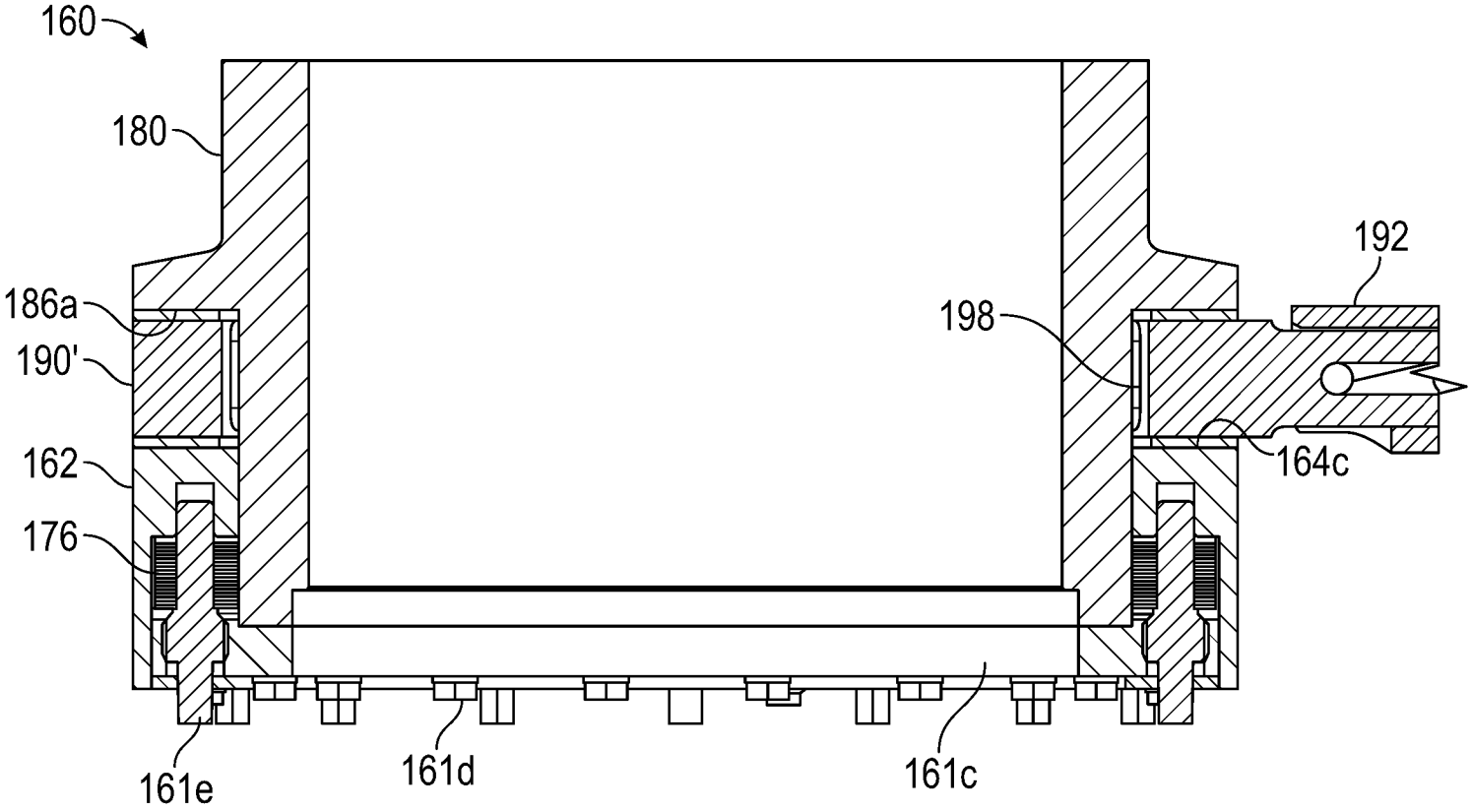
FIG. 13 illustrates a cross-sectional view of a fifth embodiment of a clutch for the flowback tool.
Figure 14A:
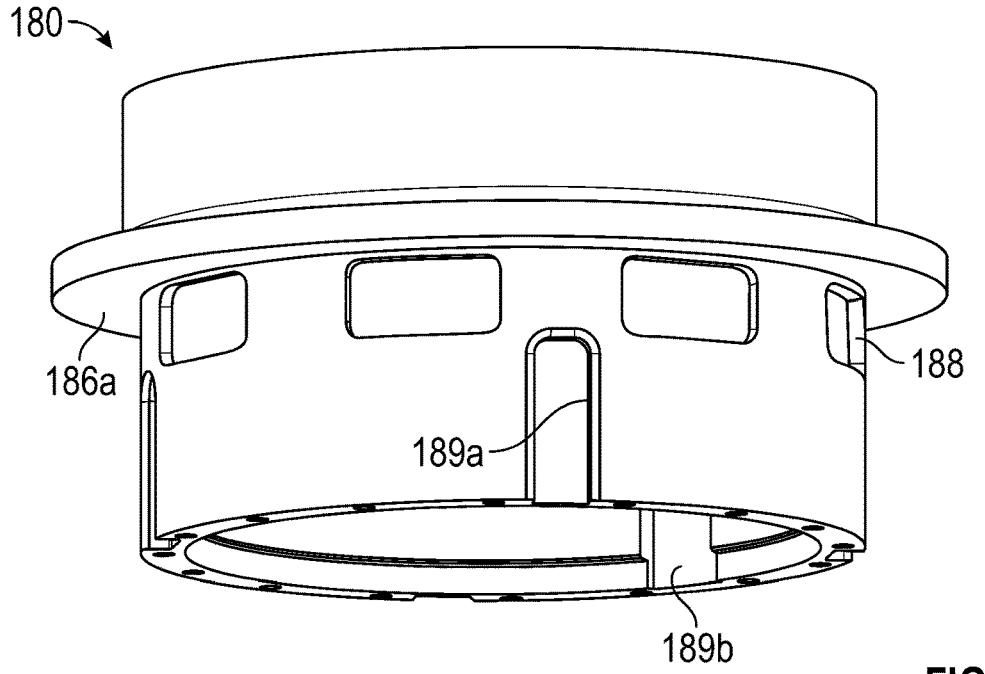
FIG. 14A illustrates a perspective view of a slip ring for the clutch of FIG. 13.
Figure 14B:
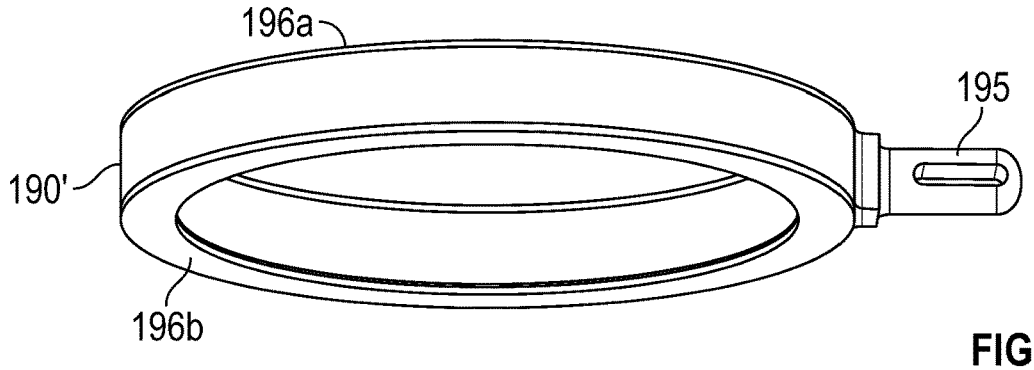
FIG. 14B illustrates a perspective view of a rotating ring for the clutch of FIG. 13.
Figure 14C:
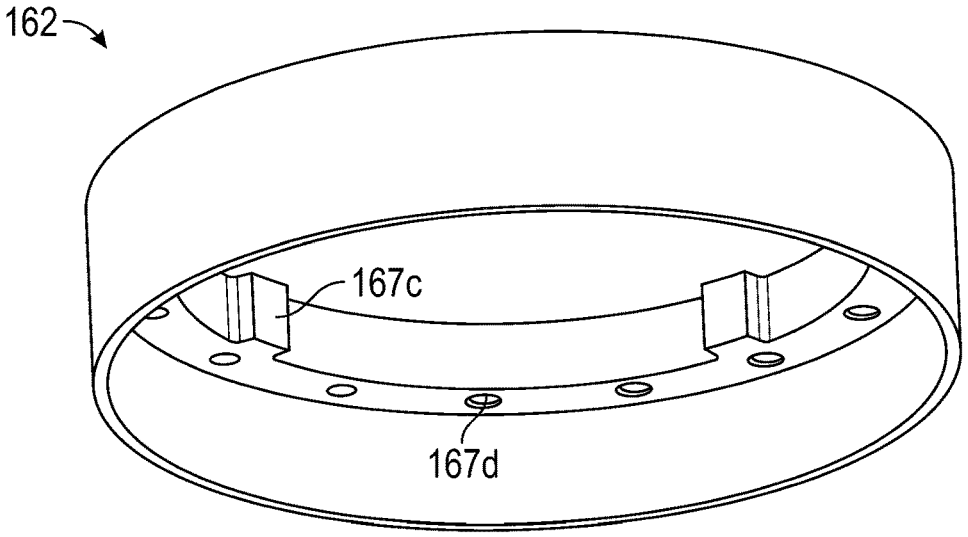
FIG. 14C illustrates a perspective view of an outer housing for the clutch of FIG. 13.
Figure 15:
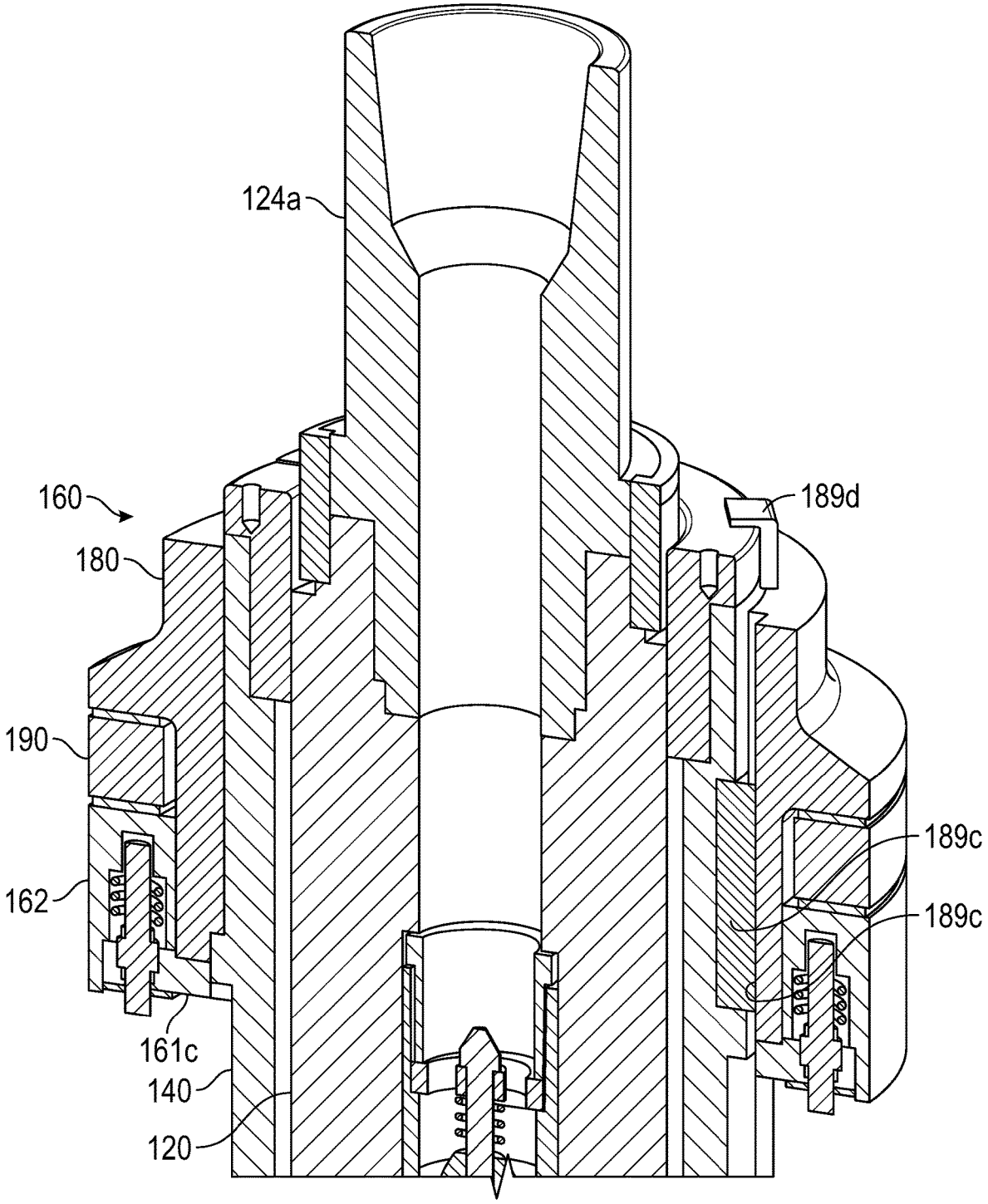
FIG. 15 illustrates a perspective view of the clutch disposed on the flowback tool.

FIG. 13 illustrates a cross-sectional view of a fifth embodiment of a clutch for the flowback tool. Again, the clutch 160 includes an outer housing 162, a slip ring 180, and a rotating brake ring 190'. For further illustration, FIGS. 14A-14C illustrate perspective views of the slip ring 180, the rotating brake ring 190', and the outer housing 162 for the clutch 160. FIG. 15 illustrates a perspective view of the clutch 160 disposed on the flowback tool 100.

As shown in FIG. 13, a support plate 161*c* is affixed with support screws 161*d* to a bottom of the slip ring 180, and adjustment pins or screws 161*e* are threaded in holes in the support plate 161*c* and extend into adjustment holes 167*d* inside the housing 162. Adjustment of the pins 161*e* changes the bias of one or more biasing elements 176 (e.g., Belleville springs) sandwiched between the support plate 161*c* and the housing 162 and changes the force that an upper shoulder 164*c* on the housing 162 exerts against the rotating brake ring 190'.

For its part, the rotating brake ring 190' has upper and lower brake pads 196*a-b* (FIG. 14B). The upper pad 196*a* can engage the slip ring's under shoulder 186*a*, while the lower pad 196*b* can engage the upper shoulder 164*c* of the housing 162. The bushings 198 shown in FIG. 13 around the slip ring 180 reduce friction between the outer surface of the slip ring 180 and the inner surface of the rotating brake ring 190'. The lever arm 192 connects to a handle 195 of the rotating brake ring 190'.

As best shown in FIG. 14A, the slip ring 180 includes outer spline slots 189*a* and inner key slots 189*b*. The outer spline slots 189*a* on the slip ring 180 engage with splines 167*c* (FIG. 14C) on the housing 162 so the slip ring 180 and housing 162 rotate together. The inner key slots 189*b* on the slip ring 180 engage keys (not shown) on the barrel (140) of the flowback tool (100) so the slip ring 180 and barrel (140) rotate together. Therefore, rotating the barrel (140) produces rotation of the slip ring 180 and the outer housing 162. However, the rotating brake ring 190 can rotate with or remain stationary relative to the slip ring 180, the outer housing 162, and the barrel (140) depending on the torque threshold from the friction between its brake pads 196*a-b* and the shoulders 164*c*, 186*a*.

Thus, as described above, the slip ring 180 is mechanically connected to the outer housing 162. In particular, the slip ring 180 has the external spline profiles 189*a* in which the splines 167*c* of the outer housing 162 engage to prevent rotation between these components. The slip ring 180 is also mechanically connected to the support pate 161*c* by the set of screws 161*d* located on the bottom of the safety clutch 160. Moreover, the slip ring 180 is mechanically connected to the barrel (140) by torque parallel keys (189*c*; FIG. 15) engaged in the slip ring's key slots 189*b* to transfer the torque, and upper supports (189*d*; FIG. 15) can be used between the slip ring 180 and portion of the barrel 140. Finally, the slip ring 180 has a set of guiding elements (i.e., brass bushings 198) mounted on the OD to center the rotating brake ring 190'.

Again, the purpose of the safety clutch 160 in this application is to prevent any damage to the thread between the mandrel (120) and the barrel (140) when the top drive quill is over-rotated in the CW or CCW direction. The basic principle of the safety clutch 160 relies on a preload applied to the Belleville springs 176 by rotating the adjustment screws 161*e* that push the outer housing 162 to increase the force acting on the brake pads 196*a-b* mounted on the rotating brake ring 190' connected to the anti-rotation arm 192. The upper and lower brake pads 196*a-b* create a friction force between the outer housing 162 and the slip ring 180, making it difficult to create a relative rotational movement of the rotating brake ring 190' and anti-rotation arm 192 unless the torque limit is reached or exceeded by the torque created by the top drive quill.

One of the only occasions where it may be required to apply a torque on the rotation arm 192 higher than the brake torque includes a well control situation when it is necessary to make up the mandrel's coupling (124*b*) to the drillpipe's connection (64) via threads. This is achieved by fully retracting the barrel (140) in CW rotation. The barrel (140) then hits a stop where it is not possible to retract anymore. At this point, the top drive quill will continue rotation in the CW direction. The torque applied to the rotation arm 192 will overcome the brake torque in the clutch 160, and then the mandrel's coupling (124*b*) can be screwed into the drillpipe's connection (64) without damaging the stub-acme threads on the mandrel (120) and the barrel (140) because the barrel (140) can essentially rotate with the turning of the mandrel (120).

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A flowback tool used on a top drive for delivering fluid flow to a tubular, the flowback tool comprising:

a mechanical stroke having an inner body and an outer body, the inner body disposed in the outer body, the inner body being rotatable about an axis, the outer body being movable in a stroke direction along the axis, the inner body having a flow passage therethrough between a connection and a coupling, the connection being configured to connect to the top drive, the coupling being configured to removably thread to the tubular, the flow passage having a valve being configured to control fluid communication between the coupling and the connection, the outer body having first and second ends, the first end disposed toward the connection, the second end disposed toward the coupling, the second end having an annular seal configured to sealably engage with the tubular; and a clutch having first and second portions, the first and second portions defining an interface with a torque threshold, the first portion being fixed on the outer body of the mechanical stroke, the second portion having a disengaged condition and an engaged condition, the second portion in the engaged condition being configured to engage with a portion of the top drive, the second portion in the engaged condition being configured to move with the first portion up to the torque threshold, the second portion in the engaged condition being configured to slip relative to the first portion beyond the torque threshold.

2. The flowback tool of claim 1, wherein the inner body is a mandrel; wherein the outer body comprises a barrel having the mandrel disposed therein; and wherein the mandrel and the barrel define a cam engagement therebetween, the mandrel being configured to rotate about the axis with rotation of the top drive, the barrel being prevented to rotate by the clutch in the engaged condition and being configured to move in the stroke direction along the axis with the rotation of the mandrel.

3. The flowback tool of claim 2, wherein the connection comprises a first crossover affixed to one end of the mandrel and having a box connection configured to connect to a quill of the top drive; and wherein the coupling comprises a second crossover affixed to an open end of the mandrel and having a pin connection.

4. The flowback tool of claim 2, wherein the mandrel comprises a circumferential seal disposed toward the coupling and being configured to seal with an interior of the barrel.

5. The flowback tool of claim 1, wherein the valve is configured to allow fluid communication from the connection to the coupling in response to a first flow differential and is configured to allow fluid communication from the coupling to the connection in response to a second flow differential.

6. The flowback tool of claim 1, wherein the annular seal comprises a conical seal having an outer edge and defining an inner opening, the outer edge held between a stop ring and a lip, the lip disposed about a perimeter on the second end of the outer body, the stop ring wedged against a ramped shoulder inside the outer body.

7. The flowback tool of claim 1, wherein the first portion of the clutch comprises:

a housing having a first shoulder and a second shoulder, the housing being fixed to the outer body of the mechanical stroke;

a first brake pad disposed in the housing adjacent the first shoulder, the first brake pad being configured to rotate with the housing;

a second brake pad disposed in the housing adjacent the second shoulder, the second brake pad being configured to rotate with the housing; and one or more biasing elements configured to bias the first brake pad away from the first shoulder; and wherein the second portion of the clutch comprises:

a slip ring disposed in the housing and having first and second surfaces, the first surface being engaged with the first brake pad, the second surface being engaged with the second brake pad, the first and second surfaces engaged with the first and second brake pads defining the interface with the torque threshold; and an arm connected to the slip ring, the arm being configured to extend radially outward from the slip ring in the engaged condition and being configured to engage with the portion of the top drive.

8. The flowback tool of claim 7, wherein each of the first and second brake pads comprises a ring having a spline defined on an outer circumference, the spline being engaged with the housing in clockwise and counterclockwise directions.

9. The flowback tool of claim 7, wherein the arm comprises a collar engaged with splines on the slip ring or engaged with fixtures to the slip ring.

10. The flowback tool of claim 7, wherein the arm is configured to pivot between the engaged and disengaged conditions, the arm in the disengaged condition being configured to extend along the axis away from the portion of the top drive.

11. The flowback tool of claim 7, wherein the clutch has a cavity for oil, the cavity defined by first, second, and third sealing members, the first sealing member disposed about an internal circumference of the housing and being configured to seal with the outer body, the second sealing member disposed about an internal circumference of the slip ring and being configured to seal with the outer body, third sealing members being configured to seal the second brake pad against an inner surface of the housing and an outer surface of the slip ring.

12. The flowback tool of claim 7, wherein the second shoulder has the second brake pad disposed thereon.

13. The flowback tool of claim 7, wherein the first brake pad comprises a plurality of first and second rings alternatingly stacked between the one or more biasing elements and the first surface of the slip ring, the first rings being configured to rotate with the housing, the second rings being configured to rotate with the slip ring.

14. The flowback tool of claim 7, wherein the one or more biasing elements comprise:

a plurality of disc springs stacked between the first shoulder and the first brake pad; or a plurality of compression springs disposed between the first shoulder and the first brake pad about a circumference of the housing.

15. The flowback tool of claim 7, comprising a push ring disposed between the one or more biasing elements and the first shoulder, the housing having one or more adjustment screws configured to displace the push ring relative to the first shoulder.

16. The flowback tool of claim 1, wherein the first portion of the clutch comprises:

a housing having a first shoulder;

a slip ring having a second shoulder, the housing and the slip ring being fixed on the outer body of the mechanical stroke; and one or more biasing elements configured to bias the first shoulder of the housing toward the second shoulder of the slip ring; and wherein the second portion of the clutch comprises a rotatable brake ring having first and second brake pads, the first and second brake pads configured to engage the first and second shoulders respectively and defining the interface with the torque threshold, the rotatable brake ring having the disengaged condition and the engaged condition, the rotatable brake ring in the engaged condition being configured to engage with the portion of the top drive, the rotatable brake ring in the engaged condition being configured to move with the housing and the slip ring of the first portion up to the torque threshold, the rotatable brake ring in the engaged condition being configured to slip relative to the housing and the slip ring of the first portion beyond the torque threshold.

17. A clutch used on a top drive having a rotatable component and a bail, the clutch comprising:

a first portion being fixed on the rotatable component of the top drive; and a second portion, the first and second portions defining an interface with a torque threshold, the second portion having a disengaged condition and an engaged condition, the second portion in the engaged condition being configured to engage with the bail of the top drive, the second portion in the engaged condition being configured to move with the first portion up to the torque threshold, the second portion in the engaged condition being configured to slip relative to the first portion beyond the torque threshold.

18. A top drive for delivering fluid flow to a tubular, the top drive comprising:

a quill extending from the top drive;

bails supported on the top drive on either side of the quill;

an elevator supported on the bails and configured to support the tubular; and a flowback tool connected to the quill and comprising:

a mechanical stroke having an inner body and an outer body, the inner body disposed in the outer body, the inner body being rotatable with the quill about an axis, the outer body being movable in a stroke direction along the axis, the inner body having a flow passage therethrough between a connection and a coupling, the connection being configured to connect to the quill, the coupling being configured to removably thread to the tubular, the flow passage having a valve being configured to control fluid communication between the coupling and the connection, the outer body having first and second ends, the first end disposed toward the connection, the second end disposed toward the coupling, the second end having an annular seal configured to sealably engage with the tubular; and a clutch having first and second portions, the first and second portions defining an interface with a torque threshold, the first portion being fixed on the outer body of the mechanical stroke, the second portion having a disengaged condition and an engaged condition, the second portion in the engaged condition being configured to engage with one of the bails of the top drive, the second portion in the engaged condition being configured to move with the first portion up to the torque threshold, the second portion in the engaged condition being configured to slip relative to the first portion beyond the torque threshold.

19. A method, comprising:

supporting a tubular in an elevator of a top drive, the top drive having a rotatable component and a bail;

extending a barrel of a flowback tool relative to a mandrel of the flowback tool by rotating the mandrel in a first direction with the rotatable component of the top drive while preventing rotation of the barrel with a clutch, the clutch comprising:

a first portion being fixed on the mandrel; and a second portion, the first and second portions defining an interface with a torque threshold, the second portion having a disengaged condition and an engaged condition, the second portion in the engaged condition being configured to engage with the bail of the top drive, the second portion in the engaged condition being configured to move with the first portion up to the torque threshold, the second portion in the engaged condition being configured to slip relative to the first portion beyond the torque threshold;

establishing a fluid connection between the mandrel and the tubular by engaging a seal on the barrel in sealed engagement with an end of the tubular; and permitting the barrel to rotate in the first direction with the rotation of the mandrel by releasing the clutch in response to the torque threshold.

20. The method of claim 19, further comprising controlling fluid communication in the fluid connection with a valve of the mandrel by permitting fluid flow through the valve in a first direction from the mandrel to the tubular in response to a first differential, and permitting fluid flow through the valve in a second opposite direction from the tubular to the tubular in response to a second differential.

21. The method of claim 19, further comprising establishing a mechanical connection between the mandrel and the tubular by engaging a coupling on the mandrel with the end of the tubular.

22. The method of claim 21, wherein engaging the coupling on the mandrel with the end of the tubular comprises threading a pin connection on the mandrel in a box connection on the end of the tubular.

* * * * *